US010744780B2

(12) United States Patent
Koganehira et al.

(10) Patent No.: US 10,744,780 B2
(45) Date of Patent: Aug. 18, 2020

(54) RECORDING APPARATUS

(71) Applicant: SEIKO EPSON CORPORATION, Tokyo (JP)

(72) Inventors: Shuichi Koganehira, Nagano (JP); Yasuhiko Kosugi, Nagano (JP); Tsuyoshi Hayashi, Nagano (JP); Toshihiro Shinbara, Nagano (JP); Kaoru Koike, Nagano (JP); Ryoji Fujimori, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 15/694,046

(22) Filed: Sep. 1, 2017

(65) Prior Publication Data

US 2018/0086092 A1 Mar. 29, 2018

(30) Foreign Application Priority Data

Sep. 28, 2016 (JP) ..... 2016-189254

(51) Int. Cl.
*B41J 2/17* (2006.01)
*B41J 2/175* (2006.01)
*B41J 29/38* (2006.01)

(52) U.S. Cl.
CPC ..... *B41J 2/17566* (2013.01); *B41J 2/175* (2013.01); *B41J 29/38* (2013.01)

(58) Field of Classification Search
None
See application file for complete search history.

(56) References Cited

U.S. PATENT DOCUMENTS

2002/0113852 A1* 8/2002 Kimura ..... B41J 2/175 347/85
2005/0018000 A1* 1/2005 Ishihara ..... B41J 2/16523 347/7
2006/0290723 A1* 12/2006 Jeong ..... B41J 2/17566 347/7
2008/0273063 A1* 11/2008 Wouters ..... B41J 2/1707 347/85
2009/0225126 A1* 9/2009 Morishita ..... B41J 2/17509 347/19

(Continued)

FOREIGN PATENT DOCUMENTS

JP 2002-307708 A 10/2002
JP 2006-188002 A 7/2006

(Continued)

*Primary Examiner* — Erica S Lin
(74) *Attorney, Agent, or Firm* — Global IP Counselors, LLP

(57) ABSTRACT

A printer has a recording head, a relay container from which ink is supplied to the recording head, and to which the ink is supplied from a terminal container, a pressurizing pump and a depressurizing pump for supplying the ink from the terminal container to the relay container, and a control unit. The control unit calculates an estimated consumption amount of the relay container based on the amount of the ink supplied from the relay container to the recording head, and consumed and the amount of the ink supplied from the terminal container to the relay container, and calculates the amount of the ink supplied from the terminal container to the relay container using the minimum value of tolerance of a supply amount of the depressurizing pump.

15 Claims, 4 Drawing Sheets

(56) References Cited

U.S. PATENT DOCUMENTS

| | | | | |
|---|---|---|---|---|
| 2011/0226340 | A1* | 9/2011 | Tokuno | B41J 2/175 137/1 |
| 2012/0026220 | A1* | 2/2012 | Igarashi | B41J 2/16526 347/6 |
| 2013/0057606 | A1* | 3/2013 | Rice | B41J 2/17546 347/7 |
| 2013/0335465 | A1* | 12/2013 | Chang | G06Q 20/28 347/5 |
| 2016/0089895 | A1 | 3/2016 | Iwase et al. | |
| 2016/0101629 | A1 | 4/2016 | Sawase | |

FOREIGN PATENT DOCUMENTS

| | | | |
|---|---|---|---|
| JP | 2016-068341 | A | 5/2016 |
| JP | 2016-078382 | A | 5/2016 |
| JP | 2016-078434 | A | 5/2016 |

* cited by examiner

RECORDING APPARATUS

The present application claims priority from Japanese Patent Application No. 2016-189254 filed on Sep. 28, 2016, the contents of which are hereby incorporated by reference into this application.

BACKGROUND

1. Technical Field

The present invention relates to a recording apparatus.

2. Related Art

As an inkjet printer that is an example of a recording apparatus, printers provided with a sub tank for supplying ink to a recording head and a main tank for supplying ink to the sub tank have been proposed (e.g., JP-A-2002-307708 and JP-A-2006-188002). In such printers, it is demanded to appropriately manage the amounts of ink in the sub tank and the main tank in order to prevent ink shortage, which is a state where ink to be supplied to the recording head runs out, from occurring.

JP-A-2002-307708 discloses an ink supply system in which the ink residual amount in the sub tank is acquired by soft-counting the amount of ink consumed from a certain state where the consumption amount of the sub tank is zero (full state) or the like, and ink is supplied from a main tank to a sub tank by operating a suction pump as necessary. The residual amount of ink in the main tank can be acquired by totaling consumption amounts (soft count values) of ink of a plurality of sub tanks.

In addition, JP-A-2006-188002 discloses a recording apparatus in which an ink level sensor provided in a sub tank detects the ink level in the sub tank, and an ink replenishing pump is operated as necessary, and thereby ink is supplied from a main tank to the sub tank. The ink residual amount in the main tank is acquired by totaling ink replenishing amounts calculated from the number of times that the ink replenishing pump was operated.

JP-A-2002-307708 and JP-A-2006-188002 are examples of related art.

Incidentally, there are cases where ink supply amounts are different between a plurality of printers due to their individual differences and the like even if the control unit of each printer supplies ink by performing the same operation when supplying ink from the main tank to the sub tank.

For example, in the case of acquiring the residual amount of ink in the sub tank from the amount of ink discharged from the recording head and the amount of ink supplied from the main tank, there is a possibility that actual ink supply amount is smaller than a calculated ink supply amount due to variation in amount of ink supplied from the main tank. If the calculated amount of ink supplied from the main tank to the sub tank is smaller than the actual ink supply amount, there is a risk that the actual ink in the sub tank runs out and ink shortage occurs when repeating an operation of discharging ink from the head, and ink supply from the main tank to the sub tank whereas the sub tank has not run out of ink according to the calculation. However, management of the ink residual amount in consideration of variation in ink supply amount is not described in JP-A-2002-307708 or JP-A-2006-188002, and a solution to the above-described issue in supplying ink to the recording head in a stable manner is not shown.

SUMMARY

The present invention has been made in order to solve at least a portion of the above-described issue, and can be realized as the following aspects and application examples.

Application Example 1

A recording apparatus according to this application example has a recording head for discharging a recording material, a first container from which the recording material is supplied to the recording head, and to which the recording material is supplied from a second container, a supply means for supplying the recording material from the second container to the first container, and a control unit, and the control unit controls an operation of the supply means, and calculates an estimated consumption amount of the first container based on an amount of the recording material supplied from the first container to the recording head and consumed and an amount of the recording material supplied from the second container to the first container by the supply means, and when calculating the estimated consumption amount of the first container based on the amount of the recording material supplied from the second container to the first container, calculates the amount of the recording material supplied from the second container to the first container using the minimum value of tolerance of a supply amount of the supply means.

According to the configuration in this application example, the control unit calculates the estimated consumption amount of the first container based on the amount of the recording material supplied from the first container to the recording head and consumed and the amount of the recording material supplied from the second container to the first container by the supply means. Here, the control unit calculates the amount of the recording material supplied from the second container to the first container by the supply means, using the minimum value of tolerance of a supply amount of the supply means. Therefore, even if the amount of the recording material supplied by the supply means varies within the range of the tolerance, the actual amount of the recording material supplied from the second container to the first container is larger than or equal to an amount of the recording material calculated using the minimum value of the tolerance. In other words, the actual residual amount of the recording material in the first container is never smaller than a residual amount estimated based on the minimum value of the tolerance of the amount of the recording material supplied by the supply means. Therefore, if the control unit manages the residual amount of the recording material estimated to be necessarily remaining in the first container based on the calculated estimated consumption amount of the first container, and causes the supply means to supply the recording material, the recording material in the first container can be prevented from running out even when the amount of the recording material supplied by the supply means varies. Accordingly, it is possible to provide a recording apparatus capable of supplying the recording material to the recording head in a stable manner.

Application Example 2

In the recording apparatus according to the above application example, it may be preferable that the control unit causes the supply means to supply the recording material from the second container to the first container when the estimated consumption amount of the first container becomes larger than or equal to a predetermined amount set based on a predetermined capacity of the first container.

According to the configuration in this application example, the recording material is not allowed to be supplied from the second container to the first container until the estimated consumption amount of the first container becomes larger than or equal to the predetermined amount, and thus it is possible to reduce the frequency at which the supply means is operated compared with a case where the recording material is supplied every time the recording material is consumed from the first container. Therefore, if preparation for operating the supply means requires a certain amount of time and the like, it is possible to reduce the ratio of a time other than an actual operation time of the supply means, and to operate the supply means in a stable manner.

Application Example 3

In the recording apparatus according to the above application example, it may be preferable that the recording apparatus further has a storage, and the control unit records the estimated consumption amount of the first container in the storage.

According to the configuration in this application example, the calculated estimated consumption amount of the first container can be recorded in the storage, and maintained.

Application Example 4

In the recording apparatus according to the above application example, it may be preferable that when the estimated consumption amount of the first container is calculated based on the amount of the recording material supplied from the second container to the first container, if the estimated consumption amount of the first container is a negative value, the control unit assumes that the estimated consumption amount of the first container is zero, and updates the estimated consumption amount of the first container in the storage.

According to the configuration in this application example, if the estimated consumption amount of the first container calculated based on the amount of the recording material supplied from the second container to the first container is a negative value, it is conceivable that the calculated amount of the recording material supplied to the first container exceeds the calculated amount of the recording material consumed from the first container, and that a state is entered where the first container is filled up with the recording material (a state where the free capacity of the first container is zero). According to the configuration in this application example, in such a case, update is performed assuming that the estimated consumption amount of the first container is zero, and thus it is possible to reset the estimated consumption amount of the first container to an initial value in the state where the first container is filled up with the recording material, and continuously manage the residual amount of the recording material.

Application Example 5

In the recording apparatus according to the above application example, it may be preferable that the control unit performs the calculation of the amount of the recording material supplied from the second container to the first container, using the minimum value of the tolerance of a supply amount of the supply means, by integrating the minimum value of the tolerance of the supply amount per unit of the recording material supplied from the second container to the first container for an operation amount of the operation of the supply means.

The amount of the recording material supplied from the second container to the first container is calculated based on the minimum value of the tolerance of a supply amount of the supply means, and thus even if the supply amount per unit for each operation of the supply means varies within the range of the tolerance, the amount of the recording material that is actually supplied is larger than or equal to the calculated supply amount that is based on the minimum value of the tolerance. Therefore, the actual residual amount of the recording material in the first container is never smaller than the residual amount estimated from the estimated consumption amount of the first container, and thus a state can be maintained where the recording material remains in the first container.

Application Example 6

In the recording apparatus according to the above application example, it may be preferable that if the recording material is supplied at the maximum value of the tolerance of the supply amount per unit of the supply means, the control unit causes the supply means to execute the operation so as to supply the recording material in an amount such that the "estimated" consumption amount of the first container is an initial value.

According to the configuration in this application example, when supplying the recording material from the second container to the first container, the operation of the supply means is executed so as to supply the recording material in an amount such that the "estimated" consumption amount of the first container is an initial value (the value in a state where the first container is filled up with the recording material) if the recording material is supplied at the maximum value of the tolerance of the supply amount per unit. Therefore, even if the supply amount per unit for each operation of the supply means varies within the range of the tolerance, the recording material can be supplied so as not to exceed a predetermined capacity of the first container, and thus it is possible to suppress reduction in the lifetime of the first container due to the recording material being charged excessively.

Application Example 7

In the recording apparatus according to the above application example, it may be preferable that the control unit sets, as a predetermined operation amount, an integer value that is smaller than or equal to a value acquired by dividing the estimated consumption amount of the first container by the maximum value of the tolerance of the supply amount per unit, and causes the supply means to execute the operation by the predetermined operation amount.

According to the configuration in this application example, the predetermined operation amount by which the supply means is operated when supplying the recording material from the second container to the first container is set to the integer value that is smaller than or equal to the value acquired by dividing the estimated consumption amount of the first container by the maximum value of the tolerance of the supply amount per unit. Therefore, even if the supply amount per unit for each operation of the supply means varies within the range of the tolerance, the amount of the recording material that is actually supplied by operating the supply means by the predetermined operation amount never exceeds the amount acquired by multiplying the maximum value of the tolerance by the predetermined operation amount. Therefore, the recording material can be supplied so as not to exceed the predetermined capacity of the first container.

Application Example 8

In the recording apparatus according to the above application example, it may be preferable that the recording apparatus has a sensor for detecting that the first container is filled with the recording material to the predetermined capacity of the first container, and if the sensor detects that the first container has been filled with the recording material to the predetermined capacity of the first container before execution of the operation of the supply means by the predetermined operation amount is complete, the control unit stops the operation of the supply means, and performs the calculation of an amount of the recording material supplied from the second container to the first container by integrating the minimum value of the tolerance of the supply amount per unit for an amount of the operation executed until the detection of the sensor.

If the sensor detects that the first container is filled with the recording material to the predetermined capacity of the first container before execution of the operation of the supply means by the predetermined operation amount is complete, a state where the first container is filled up with the recording material is indicated. According to the configuration in this application example, in such a case, the operation of the supply means is stopped, and thus the recording material is prevented from being supplied over the predetermined capacity of the first container. Accordingly, it is possible to suppress reduction in the lifetime of the first container due to the recording material being charged excessively. In addition, the value acquired by integrating the minimum value of the tolerance of the supply amount per unit of the supply means for an operation amount by which the operation was executed until the detection of the sensor is set as the amount of the recording material supplied from the second container to the first container, and thus the estimated consumption amount of the first container can be updated so as to be close to the actual state.

Application Example 9

In the recording apparatus according to the above application example, it may be preferable that the control unit corrects a value of the predetermined operation amount for the next supply of the recording material from the second container to the first container by the supply means if the sensor detects that the recording material has been charged to the predetermined capacity of the first container before execution of the operation of the supply means by the predetermined operation amount is complete.

If the sensor detects that the recording material has been charged to the predetermined capacity of the first container before execution of the operation of the supply means by the predetermined operation amount is complete, it is conceivable that the actual supply amount of the recording material by the supply means exceeds the supply amount that is estimated to be necessary from calculation, that the supply amount per unit of the supply means is larger than the minimum value of the tolerance, and that the amount of the recording material actually supplied to the recording head and consumed is smaller than the calculated amount. In such cases, if the supply means is operated by the predetermined operation amount, and the recording material is repeatedly supplied to the first container, the first container will be repeatedly filled up with the recording material again later on, and there is a risk that reduction in the lifetime of the first container is caused. According to the configuration in this application example, in such a case, the value of the predetermined operation amount when the supply means supplies the recording material to the first container for the next time is corrected, and thus the value of the predetermined operation amount can be adjusted according to the supply amount per unit of the supply means such that the first container is not repeatedly filled up with the recording material after that.

Application Example 10

In the recording apparatus according to the above application example, it may be preferable that the supply means is a valve, and the supply amount per unit is a supply amount per unit time for which the valve is opened, and the time for which the valve is open serves as the operation amount.

According to the configuration in this application example, the recording material can be supplied from the second container to the first container by opening the valve. In addition, the supply amount of the recording material supplied from the second container to the first container and a predetermined time for which the valve is opened when supplying the recording material from the second container to the first container can be calculated using the tolerance of the supply amount per unit time for which the valve is opened.

Application Example 11

In the recording apparatus according to the above application example, it may be preferable that the supply means is a pump, and the supply amount per unit is a supply amount per one driving of the pump, and the number of times that the pump is driven serves as the operation amount.

According to the configuration in this application example, the recording material can be supplied from the second container to the first container by pumps such as a pressurizing pump and a depressurizing pump. In addition, the supply amount of the recording material supplied from the second container to the first container and a predetermined number of times the pump is driven when supplying the recording material from the second container to the first container can be calculated using the tolerance of the supply amount per one driving of the pump.

Application Example 12

In the recording apparatus according to the above application example, it may be preferable that when calculating the estimated consumption amount of the first container based on the amount of the recording material supplied from the first container to the recording head and consumed, the control unit uses the maximum value of tolerance of a discharge amount of the recording material discharged from the recording head.

According to the configuration in this application example, when calculating the estimated consumption amount of the first container based on the amount of the recording material supplied from the first container to the recording head and consumed, the maximum value of the tolerance of the discharge amount of the recording material discharged from the recording head is used. Therefore, even if the discharge amount varies within the range of the tolerance, the value of the actual discharge amount never exceeds the value of a calculated discharge amount. Therefore, if the supply amount of the recording material to the first container is the same, the actual residual amount of the recording material in the first container is never smaller than the calculated residual amount, and thus it is possible to inhibit the recording material in the first container from running out.

Application Example 13

In the recording apparatus according to the above application example, it may be preferable that the second container has a second container storage, and the control unit records, in the second container storage, the estimated amount of the recording material supplied from the second container to the first container and consumed from the second container.

According to the configuration in this application example, the second container storage records the estimated consumption amount of the recording material supplied from the second container to the first container, and thus it is possible to estimate the free capacity of the second container that is based on an estimated consumption amount of the second container, in other words, the residual amount of the recording material in the second container. Accordingly, if it is presumed that the residual amount of the recording material in the second container is zero, the second container can be replaced with a new one at an appropriate timing.

Application Example 14

In the recording apparatus according to the above application example, it may be preferable that the control unit updates an estimated consumption amount of the second container based on the minimum value of the tolerance of the supply amount per unit of the supply means, and records the updated estimated consumption amount in the second container storage.

According to the configuration in this application example, when the recording material is supplied from the second container to the first container by the supply means, the supply amount calculated based on the minimum value of the tolerance of the supply amount per unit can be used in common for updating the estimated consumption amount of the second container and the estimated consumption amount of the first container. Note that if the supply amount per unit for each operation of the supply means varies within the range of the tolerance, the actual residual amount of the recording material in the second container is smaller than or equal to the residual amount estimated from the estimated consumption amount of the second container. However, even in a case where the second container has run out of the recording material after the recording material is supplied to the first container, the recording material supplied from the second container remains in the first container at that point, and thus the recording material can be supplied from the first container to the recording head until the second container is replaced.

Application Example 15

In the recording apparatus according to the above application example, it may be preferable that when the recording material is supplied from the second container to the first container by the supply means, the control unit updates the estimated consumption amount of the second container.

According to the configuration in this application example, when the recording material is supplied from the second container to the first container by the supply means, the estimated consumption amount of the second container as well as the estimated consumption amount of the first container are updated, and thus every time the recording material is supplied to the first container, it is possible to estimate the residual amount of the recording material in the second container after the recording material is supplied.

Application Example 16

In the recording apparatus according to the above application example, it may be preferable that the recording apparatus has a user interface unit, and the control unit causes the user interface unit to output display for prompting the user to replace the second container, based on the estimated consumption amount of the second container.

According to the configuration in this application example, if it is presumed, based on the estimated consumption amount of the second container, that the residual amount of the recording material in the second container is zero, it is possible to prompt the user to replace the second container using the display that is output by the user interface unit.

Application Example 17

In the recording apparatus according to the above application example, it may be preferable that the control unit causes the user interface unit to output display for prompting the user to prepare for replacing the second container, based on the estimated consumption amount of the second container.

According to the configuration in this application example, if it is presumed, based on the estimated consumption amount of the second container, that the residual amount of the recording material in the second container has become low, it is possible to prompt the user to prepare for the second container for replacement using the display that is output by the user interface unit.

Application Example 18

In the recording apparatus according to the above application example, it may be preferable that if the estimated consumption amount of the first container is larger than or equal to the predetermined capacity of the first container, the control unit checks whether or not the second container is mounted to the recording apparatus, and if the second container is not mounted to the recording apparatus, causes the user interface unit to output display for prompting the user to mount the second container.

If the estimated consumption amount of the first container is larger than or equal to the predetermined capacity of the first container, there is a possibility that the residual amount of the recording material in the first container is zero, and thus it is necessary to supply the recording material from the second container to the first container. According to the configuration in this application example, in such a case, whether or not the second container is mounted to the recording apparatus is checked, and if the second container is not mounted, it is possible to prompt the user to mount the second container, using the display that is output by the user interface unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
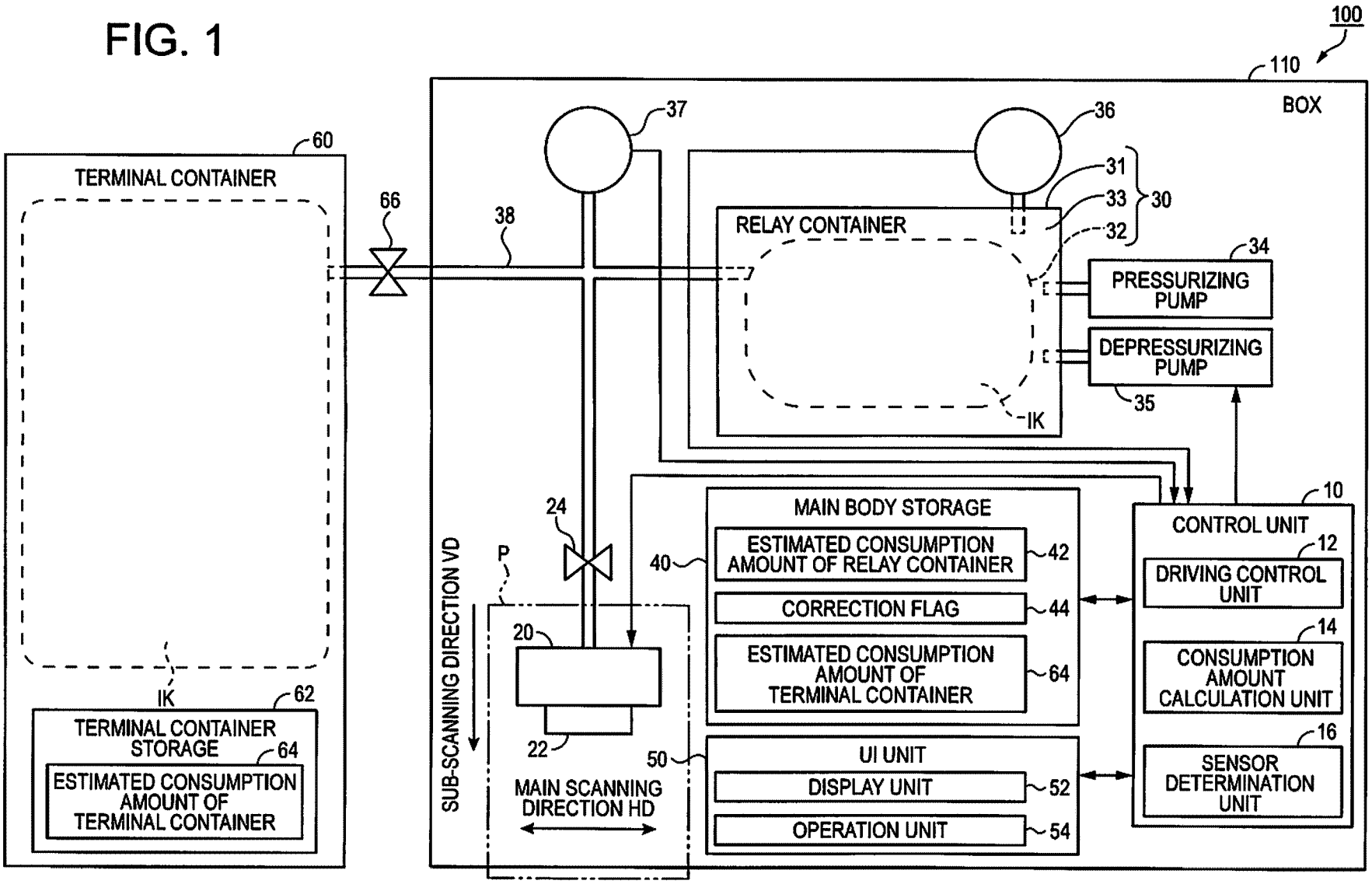
FIG. 1 is a schematic configuration diagram showing the basic configuration of a printer according to an embodiment of the invention.

Detailed embodiments of the invention will be described below with reference to the drawings. Note that in the drawings that are used, described portions may be illustrated in a simplified manner, and constituent elements other than constituent elements necessary for description may be omitted.

Basic Configuration of Printer

The basic configuration of an inkjet printer (hereinafter, simply referred to as a printer) as a recording apparatus according to this embodiment will be described with reference to FIG. 1. FIG. 1 is a schematic configuration diagram showing the basic configuration of the printer according to this embodiment. In this embodiment, a printer that is capable of printing onto a large-sized printing medium at a high speed by ejecting ink as a recording material, and is suitable for commercial printing will be described as an example.

As shown in FIG. 1, a printer 100 has a recording head 22, a relay container 30 as a first container, a terminal container 60 as a second container, a pressurizing pump 34 and a depressurizing pump 35 as a supply means (pump), a control unit 10, a main body storage 40 as a storage, a terminal container storage 62 as a second container storage, a relay container pressure sensor 36 and a channel pressure sensor 37 as a sensor, and a user interface unit (hereinafter, also referred to as a UI unit) 50.

The printer 100 has a box 110. The box 110 constitutes the outer shell of the printer 100. The recording head 22, the relay container 30, the pressurizing pump 34 and the depressurizing pump 35, the relay container pressure sensor 36 and the channel pressure sensor 37, the control unit 10, the main body storage 40, and the UI unit 50 are arranged in the box 110.

The terminal container 60 is configured to be detachable (replaceable) from the printer 100 by the user, and is arranged outside of the box 110. The terminal container 60 may be arranged in the box 110. The terminal container 60 is provided with the terminal container storage 62.

The recording head 22 is mounted on a carriage 20. The recording head 22 has a plurality of nozzles for ejecting ink IK as a recording material. The ink IK that is supplied from the relay container 30 via an ink channel 38 is ejected as ink droplets from the plurality of nozzles onto a printing medium P by the recording head 22. The control unit 10 and the carriage 20 are electrically connected via a flexible flat cable. The control unit 10 performs ejection control of the recording head 22 via the flexible flat cable.

A suction pump (not illustrated) is connected to the recording head 22. The suction pump sucks the ink IK in a channel ahead of the plurality of nozzles of the recording head 22, and ejects the ink IK from the nozzles of the recording head 22, which is not performed for printing. This makes it possible to eliminate clogging due to dirt or the like in the channel of the ink IK and clogging due to the ink IK dried at a nozzle port (this processing is also called cleaning).

The carriage 20 is driven by a carriage motor (not illustrated), and thereby reciprocally moves over the printing medium P in a main scanning direction HD. The printing medium P is conveyed by a conveyance mechanism (not illustrated) in a sub-scanning direction VD.

The relay container 30 has a case unit 31, a container bag 32 stored in the case unit 31, and a pressure chamber 33 configured between the case unit 31 and the container bag 32. The container bag 32 is formed of a flexible material in an airtight bag shape. The ink IK is stored in the container bag 32. The container bag 32 can flexibly change shape according to the amount of the ink IK that is stored, and thus when the ink IK is supplied to the recording head 22 and when the ink IK is supplied from the terminal container 60, the deaeration state of the ink IK can be maintained. Note that it is preferable not to fill the container bag 32 with too much of the ink IK in order not to reduce the lifetime of the container bag 32.

The container bag 32 is connected to the recording head 22 and the terminal container 60 via the ink channel 38. The ink IK is supplied from the container bag 32 to the recording head 22 via the ink channel 38. The ink IK is supplied from the terminal container 60 to the container bag 32 via the ink channel 38. An electromagnetic valve 24 is provided in the ink channel 38 between the container bag 32 and the recording head 22. An electromagnetic valve (check valve) 66 as a valve is provided in the ink channel 38 between the container bag 32 and the terminal container 60.

The pressurizing pump 34 and the depressurizing pump 35 are connected to the pressure chamber 33. The pressurizing pump 34 pressurizes the pressure chamber 33 when the electromagnetic valve 66 is closed and the electromagnetic valve 24 is open, whereby the container bag 32 is pressed, and the ink IK is supplied from the container bag 32 to the recording head 22. The depressurizing pump 35 depressurizes the pressure chamber 33 when the electromagnetic valve 66 is open and the electromagnetic valve 24 is closed, whereby the container bag 32 expands, and the ink IK is supplied so as to be sucked up from the terminal container 60 to the container bag 32. In this embodiment, the operation amount of the supply means is the number of times that the depressurizing pump 35 is driven. Therefore, the supply amount per unit from the terminal container 60 to the container bag 32 is the supply amount per one driving of the depressurizing pump 35.

The pressure chamber 33 is provided with the relay container pressure sensor 36 for detecting the pressure inside of the pressure chamber 33. The pressure chamber 33 is pressurized by the pressurizing pump 34 based on the pressure detected by the relay container pressure sensor 36 so as to adjust the pressure when the ink IK is supplied from the container bag 32 to the recording head 22. The pressure chamber 33 is depressurized by the depressurizing pump 35 so as to adjust the pressure when the ink IK is supplied from the terminal container 60 to the container bag 32.

The channel pressure sensor 37 for detecting the pressure of the ink IK in the channel is provided in the ink channel 38 between the container bag 32 and the terminal container 60. Based on the pressure detected by the channel pressure sensor 37, it is detected that the container bag 32 is filled up with the ink IK, the container bag 32 has run out of the ink IK, and the terminal container 60 has run out of the ink IK. Note that a state where the container bag 32 is filled up with the ink IK is referred to as being "full".

Note that FIG. 1 shows one relay container 30, one terminal container 60, one pressurizing pump 34 and depressurizing pump 35, and one relay container pressure sensor 36 and relay container pressure sensor 36 that correspond to the ink IK of one color. If the printer 100 is a color printer, the ink IK of four colors, namely, black, cyan, magenta and yellow, or five different colors or more is used, for example, and a configuration is adopted in which the relay container 30, the terminal container 60, the pressurizing pump 34 and the depressurizing pump 35, the relay container pressure sensor 36 and the channel pressure sensor 37 are provided for the ink IK of each of those colors. In addition, the relay container 30 for the ink IK of each color is connected to the recording head 22 divided for the ink IK of each color via the ink channel 38 provided for the ink IK of each color. A configuration may be adopted in which a plurality of relay containers 30 are provided in correspondence with the ink IK of one color, and the plurality of relay containers 30 are connected to one terminal container 60 for the color.

The control unit 10 has a driving control unit 12, a consumption amount calculation unit 14 and a sensor determination unit 16. The control unit 10 is constituted by a CPU, a ROM, a RAM and the like (not illustrated), and functions as a driving control unit 12 and the consumption amount calculation unit 14. The control unit 10 operates as constituent elements of the control unit 10 by loading a control program stored in the ROM to the RAM, and the CPU executing the control program loaded in the RAM, for example. Alternatively, the control unit 10 may be constituted by hardware such as an ASIC (Application Specific IC) that realizes the same function as a function executed by a CPU and a control program, instead of having the CPU, and may be constituted by both the CPU and the ASIC.

The driving control unit 12 controls operations of the recording head 22, the carriage motor and the conveyance mechanism. In the printer 100, the control unit 10 controls the recording head 22, the carriage motor and the conveyance mechanism so as to eject the ink IK from the plurality of nozzles of the recording head 22 onto the printing medium P conveyed in the sub-scanning direction VD by the conveyance mechanism while moving the carriage 20 in the main scanning direction HD, and thereby printing onto the printing medium P is performed.

In addition, the driving control unit 12 controls operations of the pressurizing pump 34 and the depressurizing pump 35 as well as the electromagnetic valve 24 and the electromagnetic valve 66. The control unit 10 controls the pressurizing pump 34 and the depressurizing pump 35 as well as the electromagnetic valve 24 and the electromagnetic valve 66 so as to supply the ink IK from the container bag 32 of the relay container 30 to the recording head 22, and to supply the ink IK from the terminal container 60 to the container bag 32 of the relay container 30.

The consumption amount calculation unit 14 integrates the consumption amounts of the ink IK supplied from the relay container 30 to the recording head 22, and consumed as well as the amounts of ink supplied from the terminal container 60 to the relay container 30, and calculates a relay container consumption amount (an estimated consumption amount of the relay container) indicating the consumption amount of the ink in the relay container 30 relative to an initial state of the relay container 30 (a state where it is presumed that the ink IK is charged to a predetermined capacity, which is also referred to as a full state). The consumption amount of ink supplied from the relay container 30 to the recording head 22 refers to a value that is equivalent to the integration amount of ink discharged from the recording head 22, and is represented by a soft count value acquired by performing so-called dot counting method. The consumption amount calculation unit 14 records the calculated estimated consumption amount of the relay container as an estimated consumption amount 42 of the relay container in the main body storage 40, which will be described later.

In addition, the consumption amount calculation unit 14 calculates a terminal container consumption amount (an estimated consumption amount of the terminal container) that is a consumption amount of the ink IK supplied from the terminal container 60 to the relay container 30, and consumed. The consumption amount calculation unit 14 records the calculated terminal container consumption amount as an estimated consumption amount 64 of the terminal container in the terminal container storage 62, which will be described later.

The sensor determination unit 16 determines, based on the pressure detected by the channel pressure sensor 37, whether or not the relay container 30 is filled with the ink IK to its predetermined capacity, or in other words, whether or not the relay container 30 is filled up with the ink IK. In addition, the sensor determination unit 16 determines, based on the pressure detected by the channel pressure sensor 37, whether or not the relay container 30 has run out of the ink IK, and whether or not the terminal container 60 has run out of the ink IK.

The main body storage 40 has a region for recording the estimated consumption amount 42 of the relay container, a region for recording a correction flag 44, and a region for recording the estimated consumption amount 64 of the terminal container. If it is detected that the relay container 30 was filled up with the ink IK before an operation of the depressurizing pump 35 for supplying the ink IK from the terminal container 60 to the relay container 30 is executed a predetermined number of times, the correction flag 44 is set.

The main body storage 40 records information in a non-volatile and rewritable manner. For example, the main body storage 40 is constituted by a non-volatile memory such as an EEPROM (Electrically Erasable Programmable Read-Only Memory). A configuration may be adopted in which the ROM of the control unit 10 also functions as the main body storage 40.

The user interface unit (UI unit) 50 has a display unit 52 for displaying notification and the like to the user, and an operation unit 54 for the user to perform operations.

The terminal container 60 has the terminal container storage 62. The terminal container storage 62 is constituted by a non-volatile memory similar to that of the main body storage 40. The terminal container storage 62 has a region for recording the estimated consumption amount 64 of the terminal container updated as the terminal container consumption amount of the terminal container 60.

The printer 100 according to this embodiment is a printer capable of printing onto the large-sized printing medium P at a high speed, and the ink consumption amount per unit job of the printer 100 is larger than that of a printer for printing a document onto A4-sized recording paper and the like.

Therefore, predetermined capacities to which the ink IK can be stored in the relay container 30 and the terminal container 60 are set large. The predetermined capacity of the relay container 30 is about 1 litter, for example, and the predetermined capacity of the terminal container 60 is about 3 litters, for example. Therefore, the depressurizing pump 35 having a large liquid feeding amount (a supply amount per unit) per operation (the number of times of driving is one) is used as a replenishing pump for replenishing the ink IK from the terminal container 60 to the relay container 30.

Operation of Supplying Ink

Subsequently, a supply operation when supplying the ink IK from the relay container 30 to the recording head 22 and a supply operation when supplying the ink IK from the terminal container 60 to the relay container 30, in the printer 100 according to this embodiment, will be described.

First, when supplying the ink IK from the relay container 30 to the recording head 22, the driving control unit 12 causes the pressurizing pump 34 to pressurize the inside of the pressure chamber 33 in a state where the electromagnetic valve 24 is open and the electromagnetic valve 66 is closed. The container bag 32 is then pressed from the outside, and thus the ink IK inside the container bag 32 is supplied to the recording head 22 via the ink channel 38.

In a state where the ink IK is not discharged from the recording head 22, it is desirable to supply the ink IK to the recording head 22 at a certain pressure so as to be able to maintain the balance with a meniscus formed in a nozzle of the recording head 22. In this embodiment, the driving control unit 12 causes the pressurizing pump 34 to pressurize the pressure chamber 33 such that the value of the pressure detected by the relay container pressure sensor 36 becomes about 35 kPa, for example, and thereby the ink IK is supplied from the container bag 32 to the recording head 22. At this time, the value of the pressure detected by the channel pressure sensor 37 is preferably about the same as the value of the pressure detected by the relay container pressure sensor 36 (e.g., 35 kPa).

When the ink IK is discharged from the recording head 22, the value of the pressure detected by the channel pressure sensor 37 decreases compared to a state where the ink IK is not discharged. At this time, the value of the pressure detected by the relay container pressure sensor 36 decreases similarly. The driving control unit 12 then causes the pressurizing pump 34 to pressurize the pressure chamber 33 so as to supply the ink IK from the container bag 32, and adjusts a pressure at which the pressurizing pump 34 pressurizes the pressure chamber 33, such that the value of the pressure detected by the channel pressure sensor 37 rises to be a fixed value.

For example, the ink IK is discharged from the recording head 22, and when the value of the pressure detected by the channel pressure sensor 37 drops to about 30 kPa, the value of the pressure detected by the relay container pressure sensor 36 is also about 30 kPa. The driving control unit 12 then causes the pressurizing pump 34 to pressurize the pressure chamber 33 such that the value of the pressure detected by the relay container pressure sensor 36 is fixed at about 35 kPa that is the above-described value.

If the value of the pressure detected by the channel pressure sensor 37 further decreases even if the pressure chamber 33 is pressurized by the pressurizing pump 34, it is conceivable that the ink IK is not supplied from the container bag 32, and the ink IK does not remain in the container bag 32. Therefore, the sensor determination unit 16 determines that the container bag 32 has run out of the ink IK. If the container bag 32 has run out of the ink IK, the value of the pressure detected by the channel pressure sensor 37 decreases rapidly in most cases rather than decreasing gradually. In such a case, the driving control unit 12 stops driving of the pressurizing pump 34.

Next, the operation of supplying the ink IK from the terminal container 60 to the relay container 30 will be described. The driving control unit 12 closes the electromagnetic valve 24 and the electromagnetic valve 66, and then opens the pressure chamber 33 to the atmospheric air to achieve a static pressure. After that, the electromagnetic valve 66 is opened. The driving control unit 12 drives the depressurizing pump 35 from this state a predetermined number of times (a predetermined operation amount) determined by the consumption amount calculation unit 14 so as to depressurize the pressure chamber 33. The ink IK in the terminal container 60 is then supplied so as to be sucked up to the container bag 32 via the ink channel 38. Note that the determination of the predetermined number of times performed by the consumption amount calculation unit 14 will be described later.

If the height of the terminal container 60 is approximately the same as the height of the relay container 30, when the value of the pressure detected by the channel pressure sensor 37 rises and reaches about 0 kPa, it is indicated that the ink IK has been supplied into the container bag 32 to its predetermined capacity. In such a case, the sensor determination unit 16 determines that the container bag 32 is filled up with the ink IK, and the driving control unit 12 stops driving of the depressurizing pump 35 so as not to fill the container bag 32 with too much of the ink IK.

Filling the container bag 32 with too much of the ink IK, expanding the container bag 32 excessively, and frequently filling the container bag 32 up with the ink IK lead to early deterioration of the container bag 32 and shorter lifetime of the relay container 30.

Note that in this embodiment, the predetermined capacity of the terminal container 60 is larger than the predetermined capacity of the container bag 32 and heavy, and thus the terminal container 60 is arranged below the relay container 30 provided in the printer 100 that is placed on a desk or the like. In such a case, the difference in water head pressure between the terminal container 60 and the relay container 30 occurs, and thus the value of the pressure detected by the channel pressure sensor 37 when the container bag 32 is filled up with the ink IK becomes a value lower than about 0 kPa that is the above-described value. In this embodiment, for example, when the value of the pressure detected by the channel pressure sensor 37 reaches about −5 kPa, the sensor determination unit 16 determines that the container bag 32 is filled up with the ink IK.

In addition, if the value of the pressure detected by the channel pressure sensor 37 is low and does not rise, if the value does not rise from about −15 kPa, for example, it is conceivable that the ink IK has not been supplied from the terminal container 60, and the ink IK does not remain in the terminal container 60. Therefore, the sensor determination unit 16 determines that the terminal container 60 has run out of the ink IK. If the sensor determination unit 16 determines that the terminal container 60 has run out of the ink IK, the driving control unit 12 stops driving of the depressurizing pump 35. In such a case, the terminal container 60 is required to be replaced with a new one.

When the terminal container 60 has run out of the ink IK, the user can remove the used-up terminal container 60 from the printer 100 in a state where the electromagnetic valve 66 is closed, and replace it with the new terminal container 60. Note that even when the terminal container 60 has run out of the ink IK, the ink IK is supplied to the recording head 22 while the ink IK remains in the container bag 32, and thus the printing operation of the printer 100 can be continued also during the time until the terminal container 60 is being replaced with a new one.

Conception regarding Ink Residual Amount Management

Next, a conception regarding management of the residual amount of the ink IK in the printer 100 according to this embodiment will be described. Note that, hereinafter, the container bag 32 of the relay container 30 is also simply referred to as the relay container 30.

In the printer 100, when the ink IK is consumed, and the recording head 22 has no ink to eject, an idling state is entered. In order to prevent the idling state from occurring, it is desirable that the consumption amount of the ink IK consumed from the relay container 30 is acquired, and the ink IK of the amount of the consumed ink is reliably replenished to the relay container 30, such that the relay container 30 does not run out of the ink IK.

Here, the consumption amount of the ink IK when the user executes printing using the printer 100 has tolerance due to individual difference of the recording head 22 and the like. In addition, the suction amount of the suction pump for sucking the ink IK from the recording head 22 also varies, and thus the consumption amount of ink consumed when the recording head 22 is cleaned and the like also varies. On the other hand, when supplying the ink IK from the terminal container 60 to the relay container 30, the depressurizing pump 35 having a large liquid feeding amount (supply amount per unit) for each operation is used, and thus variation in supply amount per unit is also large. Therefore, regarding the management of the residual amount of the ink IK, variation in the consumption amount of the ink IK supplied to the recording head 22 and consumed from the relay container 30 and variation in the supply amount of the ink IK supplied from the terminal container 60 to the relay container 30 need to be taken into consideration.

In this embodiment, first, the consumption amount calculation unit 14 calculates the consumption amount of the ink IK consumed from the relay container 30, that is, the discharge amount of the ink IK that is discharged from the recording head 22, using the maximum value of tolerance due to individual difference of the recording head 22 and the like. The consumption amount calculated using the maximum value of the tolerance in this manner is never smaller than the actual consumption amount. In other words, even if the consumption amount of the ink IK varies within the range of the tolerance due to individual difference of the recording head 22 and the like, the actual residual amount of the ink IK in the relay container 30 is never smaller than a calculated residual amount.

In addition, the consumption amount calculation unit 14 calculates the supply amount of the ink IK supplied from the terminal container 60 to the relay container 30, using the minimum value of the tolerance of the supply amount per one driving of the depressurizing pump 35. The supply amount calculated using the minimum value of the tolerance of the supply amount per unit in this manner is never larger than the actual supply amount. In other words, the actual supply amount of the ink IK supplied into the relay container 30 is never smaller than the calculated supply amount. Therefore, even if the supply amount per unit varies within the range of the tolerance, the actual residual amount of the ink IK in the relay container 30 after the ink IK was supplied to the relay container 30 is never smaller than the calculated residual amount.

In this manner, the consumption amount of ink consumed from the relay container 30 is calculated using the maximum value of the tolerance due to the individual difference of the recording head 22 and the like, and the ink IK is replenished to the relay container 30 such that the calculated residual amount does not become zero based on this consumption amount. When replenishing the ink, if the residual amount of the ink IK in the relay container 30 is acquired based on the supply amount calculated using the minimum value of the tolerance of the supply amount per unit, the relay container 30 can be prevented from running out of the ink IK.

On the other hand, in the above-described method, the actual residual amount of the ink IK in the relay container 30 is larger than or equal to the calculated residual amount, and the actual supply amount of the ink IK supplied from the terminal container 60 to the relay container 30 is larger than or equal to the calculated supply amount, and thus the actual residual amount of the ink IK in the relay container 30 is larger than the calculated residual amount. Therefore, the difference between the actual residual amount of the ink 1K in the relay container 30 and the calculated residual amount increases as the ink IK is repeatedly supplied from the terminal container 60 to the relay container 30.

If ink supply from the terminal container 60 is executed until the relay container 30 is made full (until the channel pressure sensor 37 detects the full state), the frequency at which the relay container 30 is filled up with the ink IK increases. The higher the frequency at which the relay container 30 is filled up with the ink IK is, the higher the risk of reduction in the lifetime of the container bag 32 becomes.

In view of this, in this embodiment, a configuration is adopted in which, when supplying the ink IK to the relay container 30, control is performed such that the relay container 30 is filled up with the ink IK as less frequently as possible while avoiding depletion of the ink IK in the relay container 30. Ink supply from the terminal container 60 is controlled such that the relay container 30 is made full as less frequently as possible, and on the other hand, if the relay container 30 is filled up with the ink IK during ink supply, correction for reducing the next supply amount of the ink IK is performed such that the relay container 30 is not filled up when the ink IK is supplied to the relay container 30 for the next time.

A configuration is adopted in which if the relay container 30 is filled up with the ink IK during ink supply, the relay container consumption amount is reset to an initial value (the consumption amount of the relay container 30 is set to 0), so as to eliminate the difference between the actual residual amount of the ink IK in the relay container 30 and the calculated residual amount.

In addition, a configuration is adopted in which when the ink IK in the terminal container 60 runs out, the ink IK cannot be supplied to the relay container 30, and thus when the terminal container consumption amount becomes larger than or equal to a predetermined threshold value (when the residual amount of the ink IK in the terminal container 60 becomes low), a notification for prompting the user to prepare for replacement such as preparation of the new terminal container 60 at an early stage is given.

Method for Calculating Consumption Amount and Supply Amount of Ink

Subsequently, a method for calculating the consumption amounts of the ink IK of the relay container 30 and the terminal container 60 in the printer 100 according to this embodiment will be described.

First, the relay container consumption amount (the estimated consumption amount of the first container) of the relay container 30 will be described. The relay container consumption amount is an amount acquired by integrating the amounts of the ink IK supplied from the relay container 30 to the recording head 22, and consumed, and subtracting therefrom the amounts of the ink IK supplied from the terminal container 60 to the relay container 30. In this embodiment, the initial value of the relay container consumption amount is set to zero (0). In other words, in this embodiment, a state where the free capacity of the relay container 30 is zero, that is, a state where the relay container 30 is filled with the ink IK to the predetermined capacity of the relay container 30 (the full state) is set as the initial state. The relay container consumption amount indicates the present amount of the ink IK consumed from the relay container 30, relative to the initial state.

The consumption amount calculation unit 14 calculates a discharge amount (an ink consumption amount) of the ink IK discharged by being ejected from the nozzles of the recording head 22 when a printing job or cleaning of the recording head 22 is executed. The discharge amount is calculated by integrating consumption amounts of ink consumed for respective discharge operations for the number of dots necessary for image data to be printed based on the image data to be printed, the consumption amounts depending on the design of the recording head 22. In addition, a consumption amount of ink consumed during an operation other than a printing operation such as cleaning is also calculated as a discharge amount.

At this time, the maximum value of the tolerance due to individual difference of the recording head 22 or the like is used as a discharge amount of the ink IK that is discharged from the recording head 22. For example, regarding the discharge amount of the ink IK per one discharge operation, the minimum value of the tolerance is set to 1.0, and on the other hand, the maximum value of the tolerance is set to 1.2. The discharge amount of the ink IK when a job is executed is calculated by multiplying the maximum value of the discharge amount of the ink IK per one discharge operation (1.2 times the minimum value) by the number of times of the discharge operations.

Note that the discharge amount of the ink IK is represented in weight of the ink IK. Therefore, the relay container consumption amount, the terminal container consumption amount, and a supply amount of the ink IK (which will be described below) are represented in weight of the ink IK.

The consumption amount calculation unit 14 records, in the main body storage 40, the relay container consumption amount acquired by integrating discharge amounts (ink consumption amounts) as well as supply amounts from the initial state (the initial value is zero), as the estimated consumption amount 42 of the relay container. The consumption amount calculation unit 14 calculates a discharge amount every time the ink IK is discharged from the recording head 22, and adds the calculated discharge amount to the estimated consumption amount 42 of the relay container, which is the latest value of the relay container consumption amount read out from the main body storage 40.

The consumption amount calculation unit 14 then records, in the main body storage 40, the value acquired by adding the discharge amount to the estimated consumption amount 42 of the relay container, as the estimated consumption amount 42 of the relay container. Accordingly, the relay container consumption amount is updated to a value after the ink IK was discharged. When the minimum value of the tolerance of a discharge amount is assumed to be 1.0 as in the above-described example, the relay container consumption amount (the estimated consumption amount 42 of the relay container) that is recorded in the main body storage 40 takes a value that is 1.2 times a value that is based on the minimum value of the tolerance.

Note that the relay container consumption amount is updated every time a printing job or cleaning of the recording head 22 is executed, but supply of the ink IK to the relay container 30 is not performed every time the relay container consumption amount is updated, but is performed when the relay container consumption amount becomes larger than or equal to a "predetermined amount". The reason for this is as follows.

In the printer 100 of this embodiment, when supplying the ink IK from the terminal container 60 to the relay container 30, the electromagnetic valve 24 is closed, and thus printing is not executed while the ink IK is being supplied to the relay container 30. Therefore, if the ink IK is frequently supplied to the relay container 30, a time during which the printer 100 continuously operates is shortened.

In addition, if the ink IK is frequently supplied to the relay container 30, the relay container 30 (the container bag 32) is repeatedly depressurized and expanded. Also, if supply of the ink IK is frequently repeated in a state where the actual consumption amount of the relay container 30 is low, the container bag 32 will be frequently filled up with the ink IK, and thus reduction in the lifetime of the relay container 30 is caused.

Furthermore, if the ink IK is supplied from a state where the relay container 30 is nearly filled up, there is also a risk in that an error occurs in determination that the container bag 32 is filled up with the ink IK, determination being based on the pressure detected by the channel pressure sensor 37. Therefore, the relay container consumption amount is updated, but the ink IK is not supplied to the relay container 30 every time the relay container consumption amount is updated, but is supplied when the relay container consumption amount is larger than or equal to the "predetermined amount".

The "predetermined amount" of the relay container consumption amount is a value that is set based on the predetermined capacity of the relay container 30. More specifically, the "predetermined amount" of the relay container consumption amount is set as the relay container consumption amount (i.e., the free capacity of the relay container 30) corresponding to the residual amount of the ink IK that is desired to remain in the relay container 30 in order to prevent the ink IK in the relay container 30 from running out.

The "predetermined amount" of the relay container consumption amount is preferably set as appropriate in consideration of a user's use condition of the ink IK (image data to be printed, the amount of the printing medium P to be used, and the like). The higher the "predetermined amount" is set, the more the operation efficiency of the printer 100 is improved, but the lower the residual amount of the ink IK in the relay container 30 at the time when the ink IK is supplied becomes, and thus a time for which printing can be continued only using the ink IK in the relay container 30 is shortened if the terminal container 60 has run out of the ink IK.

For example, if the user uses roll paper as the printing medium P, the "predetermined amount" may be set to an amount that enables printing in units of rolls of paper. With such a configuration, while the user is executing printing onto one roll of paper, the relay container consumption amount does not reach the predetermined amount, and thus the ink IK is not supplied from the terminal container 60 to the relay container 30, and the printing operation does not stop. When printing onto one roll of paper is complete, the relay container consumption amount reaches the predetermined amount. A configuration is possible in which while the roll paper is being replaced (while the printing operation is being stopped according to a user operation), the ink IK is supplied from the terminal container 60 to the relay container 30.

In this embodiment, the "predetermined amount" is set to about 30% of the predetermined capacity of the relay container 30, for example. In this embodiment, when the predetermined capacity of the relay container 30 is 1 L. A configuration is adopted in which when the estimated consumption amount of the relay container 30 reaches an amount corresponding to 0.3 L or more, the ink IK is supplied from the terminal container 60 to the relay container 30.

When the relay container consumption amount (the estimated consumption amount 42 of the relay container) becomes larger than or equal to the predetermined amount, the consumption amount calculation unit 14 calculates a necessary amount of the ink IK to be supplied from the terminal container 60 to the relay container 30. The necessary amount of the ink IK is an amount that causes the free capacity of the relay container 30 to be zero, or in other words, an amount that causes the relay container consumption amount (the estimated consumption amount 42 of the relay container) to reach its initial value (zero).

The consumption amount calculation unit 14 divides the relay container consumption amount (the estimated consumption amount 42 of the relay container) by the supply amount per unit so as to calculate the number of times (the predetermined number of times) of driving of the depressurizing pump 35 required for bringing the relay container consumption amount to the initial value. If the calculated value includes a fraction, an integer value that is smaller than or equal to the calculated value is set as the predetermined number of times. When calculating the number of times of driving of the depressurizing pump 35, the maximum value of the tolerance of the supply amount per unit is used. For example, regarding the supply amount per unit, the minimum value of the tolerance is set to 1.0, and the maximum value of the tolerance is set to 1.5.

The supply amount per unit when actually driving the depressurizing pump 35 is smaller than or equal to the maximum value of the tolerance, and thus the amount of the ink IK that is actually supplied to the relay container 30 by driving the depressurizing pump 35 the number of times of driving (the predetermined number of times) calculated using the maximum value of the tolerance (1.5 times the minimum value) never exceeds the amount of the ink IK acquired by multiplying the maximum value of the tolerance of the supply amount per unit by the predetermined number of times. Therefore, if the driving control unit 12 drives the depressurizing pump 35 the predetermined number of times calculated using the maximum value of the tolerance, even if the supply amount per unit varies, it is possible to avoid excessive filling of the relay container 30 (the container bag 32) with the ink IK.

In addition, when supplying the ink IK from the terminal container 60 to the relay container 30, even if the relay container 30 is not filled up with the ink IK, the driving control unit 12 stops driving of the depressurizing pump 35 when the predetermined number of times is reached. Therefore, compared with a case where the depressurizing pump 35 is continuously driven until the channel pressure sensor 37 detects that the relay container 30 has been filled up with the ink IK, the frequency at which the relay container 30 is filled up with the ink IK can be reduced, and thus risk of reduction in the lifetime of the relay container 30 (the container bag 32) can be suppressed.

Moreover, even if the channel pressure sensor 37 is not properly operating, and it is not possible to detect that the relay container 30 is filled up with the ink IK, or abnormality such as leakage of the ink IK from the relay container 30 (the container bag 32) occurs, when the predetermined number of times is reached, the driving control unit 12 stops driving of the depressurizing pump 35, and thus continuous supply of the ink IK can be avoided. Accordingly, if abnormality occurs, damage accompanied by the occurrence of the abnormality can be suppressed to be low.

When the driving control unit 12 drives the depressurizing pump 35 the predetermined number of times, and the ink IK is supplied from the terminal container 60 to the relay container 30, the consumption amount calculation unit 14 calculates the supply amount of the ink IK supplied to the relay container 30. Here, the minimum value of the tolerance (in this embodiment, 1/1.5 times the maximum value) is used as the supply amount per unit. Accordingly, the consumption amount calculation unit 14 integrates the minimum values of the tolerance of the supply amount per unit for the predetermined number of times, and calculates the supply amount of the ink IK supplied to the relay container 30.

With such a configuration, the supply amount per unit when actually driving the depressurizing pump 35 is larger than or equal to the minimum value of the tolerance, and thus the amount of the ink IK that is actually supplied to the relay container 30 by the driving control unit 12 driving the depressurizing pump 35 the predetermined number of times is never lower than the calculated supply amount acquired by multiplying the minimum value of the tolerance of the supply amount per unit by the predetermined number of times. Therefore, if the residual amount of the ink IK in the relay container 30 (the container bag 32) is managed based on the supply amount of the ink IK calculated using the minimum value of the tolerance, depletion of the ink IK in the relay container 30 can be avoided.

After calculating the supply amount of the ink IK supplied to the relay container 30, the consumption amount calculation unit 14 subtracts the calculated supply amount of the ink IK from the relay container consumption amount (the estimated consumption amount 42 of the relay container) updated before the ink IK was supplied. The consumption amount calculation unit 14 then records, in the main body storage 40, the value acquired by subtracting the supply amount of the ink IK from the relay container consumption amount, as the estimated consumption amount 42 of the relay container. Accordingly, the relay container consumption amount is updated to a value after the ink IK was supplied.

Note that the relay container consumption amount is equivalent to the free capacity of the relay container 30 that is updated with the initial state being set to zero, and thus if the consumption amount calculation unit 14 calculates the amount of ink properly supplied to the relay container 30, and subtracts the calculated amount of ink from the relay container consumption amount, the relay container consumption amount never becomes negative. However, if there is an error in update, transmission and the like of the data of the relay container consumption amount, there is a possibility that the relay container consumption amount becomes negative. If the relay container consumption amount that has been updated to the value acquired by subtracting the supply amount of the ink IK becomes a negative value, the control unit 10 updates the relay container consumption amount to the initial value (zero), and records the updated relay container consumption amount in the main body storage 40.

As described above, in this embodiment, the consumption amount of the ink IK consumed from the relay container 30 is calculated using the maximum value of the tolerance of the amount of the ink IK discharged from the recording head 22. The supply amount of the ink IK supplied from the terminal container 60 to the relay container 30 is calculated using the minimum value of the tolerance for one operation when supplying the ink IK from the terminal container 60 to the relay container 30, and the residual amount of the ink IK in the relay container 30 is managed based on the relay container consumption amount (the estimated consumption amount of the first container) acquired as a result of the calculation.

Therefore, a discharge amount for one discharge operation of the ink IK actually discharged from the recording head 22 is smaller than the maximum value of the tolerance, and the supply amount per unit when the ink IK is actually supplied to the relay container 30 is not less than the minimum value of the tolerance, and thus the actual residual amount of the ink IK in the relay container 30 tends to be excessive compared with the calculated residual amount.

Therefore, if the ink IK is repeatedly supplied to the relay container 30 in such a state, the supply becomes excessive for the actual consumption amount of the ink IK in the relay container 30, and the difference between the actual residual amount of the ink IK and the calculated residual amount becomes large. Therefore, when supplying the ink IK from the terminal container 60 to the relay container 30, there are cases where the relay container 30 is filled up with the ink IK before the depressurizing pump 35 completes the operation the predetermined number of times.

When the relay container 30 is filled up with the ink IK, the channel pressure sensor 37 detects that state. If the channel pressure sensor 37 detects that the relay container 30 is filled up with the ink IK, the driving control unit 12 stops driving of the depressurizing pump 35 even before the depressurizing pump 35 operates the predetermined number of times. Accordingly, the relay container 30 is inhibited from being excessively filled with the ink IK.

When the driving control unit 12 stopped driving of the depressurizing pump 35 before the depressurizing pump 35 completes the operation the predetermined number of times, the relay container 30 is filled up with the ink IK. Therefore, when calculating the relay container consumption amount, the consumption amount calculation unit 14 updates the relay container consumption amount (the estimated consumption amount 42 of the relay container) to the initial value (zero) without subtracting the supply amount of the ink IK corresponding to the number of operation times of the depressurizing pump 35. Accordingly, the calculated relay container consumption amount is reset to a state where the free capacity of the relay container 30 is zero, or in other words, a state where the relay container 30 is filled up with the ink IK, and thus the difference between the actual residual amount of the ink IK and the calculated residual amount can be eliminated.

If the driving control unit 12 stopped driving of the depressurizing pump 35 before completing the operation the predetermined number of times due to the actual residual amount of the ink IK in the relay container 30 being excessive, it is possible that the relay container 30 will be filled up with the ink IK before the depressurizing pump 35 completes the operation the predetermined number of times also when supplying the ink IK to the relay container 30 for the next time. The higher the frequency at which the relay container 30 is filled up with the ink IK is, the higher the risk of reduction in the lifetime of the relay container 30 (the container bag 32) becomes.

In view of this, in this embodiment, if the driving control unit 12 stopped driving of the depressurizing pump 35 before the depressurizing pump 35 completes the operation the predetermined number of times, the control unit 10 performs correction for reducing the amount of the ink IK that will be supplied to the relay container 30 from the next time onward. In addition, if such correction is performed, the control unit 10 sets the correction flag 44 in the main body storage 40.

As an example of a correction method, when calculating the number of times (the predetermined number of times) of driving of the depressurizing pump 35 required for supplying the ink IK from the terminal container 60 to the relay container 30, the consumption amount calculation unit 14 sets a margin. Specifically, the consumption amount calculation unit 14 further multiplies the maximum value of the tolerance (1.5 times the minimum value of tolerance) of the supply amount per unit by a coefficient as the margin to calculate the number of times of driving of the depressurizing pump 35.

For example, if the coefficient is set to 1.4, the supply amount per unit after the correction will be (1.5×1.4=) 2.1 times the minimum value of the tolerance of the supply amount per unit. In view of this, the consumption amount calculation unit 14 calculates the number of times of driving of the depressurizing pump 35 required for bringing the relay container consumption amount to the initial value, using the supply amount per unit after the correction (2.1 times the minimum value). The number of times of driving of the depressurizing pump 35 calculated after the correction is 1/1.4 times smaller than the number of times of driving before the correction. Therefore, if the actual supply amount per unit is the same, the amount of the ink IK that is supplied to the relay container 30 after the correction is 1/1.4 times smaller than the amount of the ink IK before the correction.

Note that if the ink IK is repeatedly supplied to the relay container 30 in a state where correction for reducing the amount of the ink IK that is supplied to the relay container 30 is performed, the actual residual amount of the ink IK becomes smaller than the calculated residual amount, and as a result, there is a risk in that the relay container 30 runs out of the ink IK.

In view of this, when supplying the ink IK to the relay container 30 in the state where correction has been performed, if the channel pressure sensor 37 did not detect that the relay container 30 was filled up with the ink IK, or in other words, if the depressurizing pump 35 operated until the predetermined number of times is reached, and was stopped, the control unit 10 will not perform correction for the next time. In other words, if the depressurizing pump 35 operated until the predetermined number of times was reached, and was stopped, and the correction flag 44 was set, the control unit 10 releases the correction flag 44.

Note that regardless of the value of the relay container consumption amount (the estimated consumption amount 42 of the relay container), if the channel pressure sensor 37 detected that the relay container 30 has run out of the ink IK, and the terminal container 60 is not mounted, the control unit 10 stops the printing operation of the printer 100 in order to avoid the idling state.

In addition, even if depletion in the relay containers 30 is not detected by the channel pressure sensor 37, when the relay container consumption amount (the estimated consumption amount 42 of the relay container) becomes larger than or equal to the predetermined capacity of the relay container 30, it is possible that the relay container 30 has run out of the ink IK. Therefore, in such a case, if the terminal container 60 is not mounted, the control unit 10 stops the printing operation of the printer 100.

Next, the terminal container consumption amount (an estimated consumption amount of the second container) of the terminal container 60 will be described. The terminal container consumption amount is the amount of the ink IK estimated to have been consumed from the terminal container 60 by being supplied to the relay container 30. In this embodiment, the initial value of the terminal container consumption amount is set to zero (0). In other words, the state of the new terminal container 60 that is filled up with the ink IK to its predetermined capacity (the free capacity is zero) is set as the initial state. The consumption amount calculation unit 14 updates the terminal container consumption amount based on the ink IK being supplied from the terminal container 60 to the relay container 30, and records, in the terminal container storage 62, the updated terminal container consumption amount as the estimated consumption amount 64 of the terminal container.

The consumption amount calculation unit 14 adds the amount of the ink IK calculated by integrating the terminal container consumption amount calculated every time the ink IK is supplied from the terminal container 60 to the relay container 30, that is, the minimum value of the tolerance of the supply amount per unit for the predetermined number of times, to the estimated consumption amount 64 of the terminal container read out from the terminal container storage 62. The consumption amount calculation unit 14 then records, in the terminal container storage 62, the estimated consumption amount 64 of the terminal container after the addition. Accordingly, the terminal container consumption amount is updated to the value after the ink IK was supplied.

In this embodiment, the terminal container consumption amount is a value calculated based on the calculated supply amount of the ink IK supplied from the terminal container 60 to the relay container 30, that is, the minimum value of the tolerance of the supply amount per unit (1/1.5 times the maximum value). Therefore, in consideration of variation in supply amount per unit, the consumption amount of the ink IK actually supplied from the terminal container 60 to the relay container 30 is larger than the calculated terminal container consumption amount.

In other words, it is highly possible that the actual residual amount of the ink IK in the terminal container 60 is smaller than the residual amount estimated based on the calculated terminal container consumption amount, and thus there is a possibility that the terminal container 60 runs out of the ink IK before the terminal container consumption amount reaches the predetermined capacity of the terminal container 60. In view of this, in this embodiment, the control unit 10 estimates the residual amount of the ink IK in the terminal container 60 based on the terminal container consumption amount (the estimated consumption amount 64 of the terminal container), but whether or not the terminal container 60 has run out of the ink IK is determined based on the detection performed by the channel pressure sensor 37.

If the channel pressure sensor 37 detects that the terminal container 60 has run out of the ink IK when the ink IK was supplied from the terminal container 60 to the relay container 30, the driving control unit 12 stops driving of the depressurizing pump 35, even before the depressurizing pump 35 completes the operation the predetermined number of times, and stops the operation of supplying ink from the terminal container 60 to the relay container 30. Printing is performed using the ink IK remaining in the relay container 30 after the ink supply operation is stopped, and thus the printing operation of the printer 100 is not stopped. The user can continue the printing operation of the printer 100 while the ink IK remains in the relay container 30.

However, if the terminal container 60 has run out of the ink IK, the terminal container 60 needs to be quickly replaced with a new one. It is desirable that the terminal container 60 for replacement is prepared near the user, but it is possible that the terminal container 60 is out of stock. In view of this, in this embodiment, the user is requested to prepare for replacement of the terminal container 60 if the terminal container consumption amount reaches a predetermined threshold value before the terminal container 60 runs out of the ink IK.

In this embodiment, a first threshold value and a second threshold value are set as predetermined threshold values of the terminal container consumption amount. The first threshold value is a calculated terminal container consumption amount when the terminal container 60 runs out of ink in the printer 100 in which the supply amount of the ink IK that is actually supplied from the terminal container 60 to the relay container 30 is the standard value of the tolerance. In this embodiment, when the terminal container consumption amount at which the terminal container 60 becomes empty if the amount of ink supplied from the terminal container 60 to the relay container 30 is the minimum value of the tolerance is assumed to be 100%, the first threshold value is set to be 80%. A configuration is adopted in which when the terminal container consumption amount reaches the first threshold value, the user is prompted to prepare for replacing the terminal container 60.

The second threshold value is a calculated terminal container consumption amount when the terminal container 60 runs out of ink in the printer 100 in which the supply amount of the ink IK that is actually supplied from the terminal container 60 to the relay container 30 is the maximum value of the tolerance. In this embodiment, when the terminal container consumption amount at which the terminal container 60 becomes empty if the amount of ink supplied from the terminal container 60 to the relay container 30 is the minimum value of the tolerance is assumed to be 100%, the second threshold value is set to be 66%. A configuration is adopted in which when the terminal container consumption amount reaches the second threshold value, the user is prompted to check the stock of the terminal container 60 for replacement, and to arrange one if the terminal container 60 is out of stock.

Note that even if the terminal container consumption amount becomes larger than or equal to the predetermined capacity of the terminal container 60, if the ink IK is continuously supplied to the relay container 30 without depletion of the ink IK in the terminal container 60 being detected, it is conceivable that the channel pressure sensor 37 is not properly operating, or that abnormality such as leakage of the ink IK from the relay container 30 has occurred. In such a case, in order to check occurrence of abnormality, it is determined whether or not the terminal container consumption amount is larger than or equal to an abnormality detection threshold value.

As described above, in this embodiment, the consumption amount of the ink IK consumed from the relay container 30 is calculated using the maximum value of the tolerance of the amount of the ink IK discharged from the recording head 22. Therefore, when the relay container consumption amount at which the terminal container 60 becomes empty if the amount of ink supplied from the terminal container 60 to the relay container 30 is the minimum value of the tolerance is assumed to be 100%, the abnormality detection threshold value is set to be about 120%.

The terminal container consumption amount (the estimated consumption amount 64 of the terminal container) is recorded in the terminal container storage 62. Accordingly, even if the terminal container 60 is removed from the printer 100 in a state where the ink IK remains in the terminal container 60, the terminal container consumption amount at the time of the removal is recorded in the terminal container storage 62 of the terminal container 60. Therefore, if the terminal container 60 that has been removed once is mounted to the printer 100, and is used, the consumption amount calculation unit 14 can update the terminal container consumption amount by adding the supply amount of the ink IK supplied from the terminal container 60 after the mounting to the terminal container consumption amount at the time of the removal.

Flow of Processing for Managing Ink Residual Amount

Figure 2:
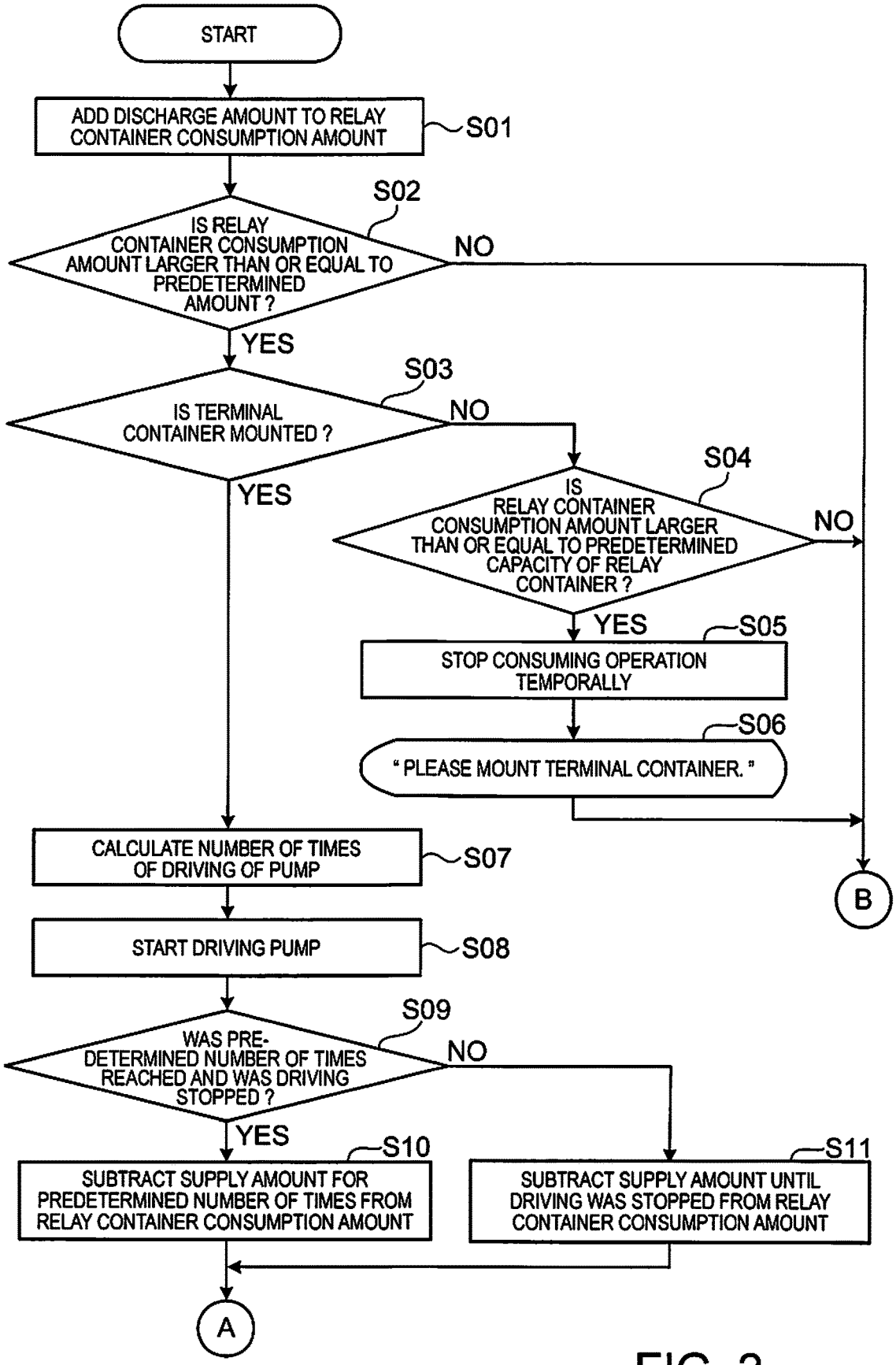
FIG. 2 is a flowchart showing processing for managing the ink residual amount in the printer according to the embodiment.
Figure 3:
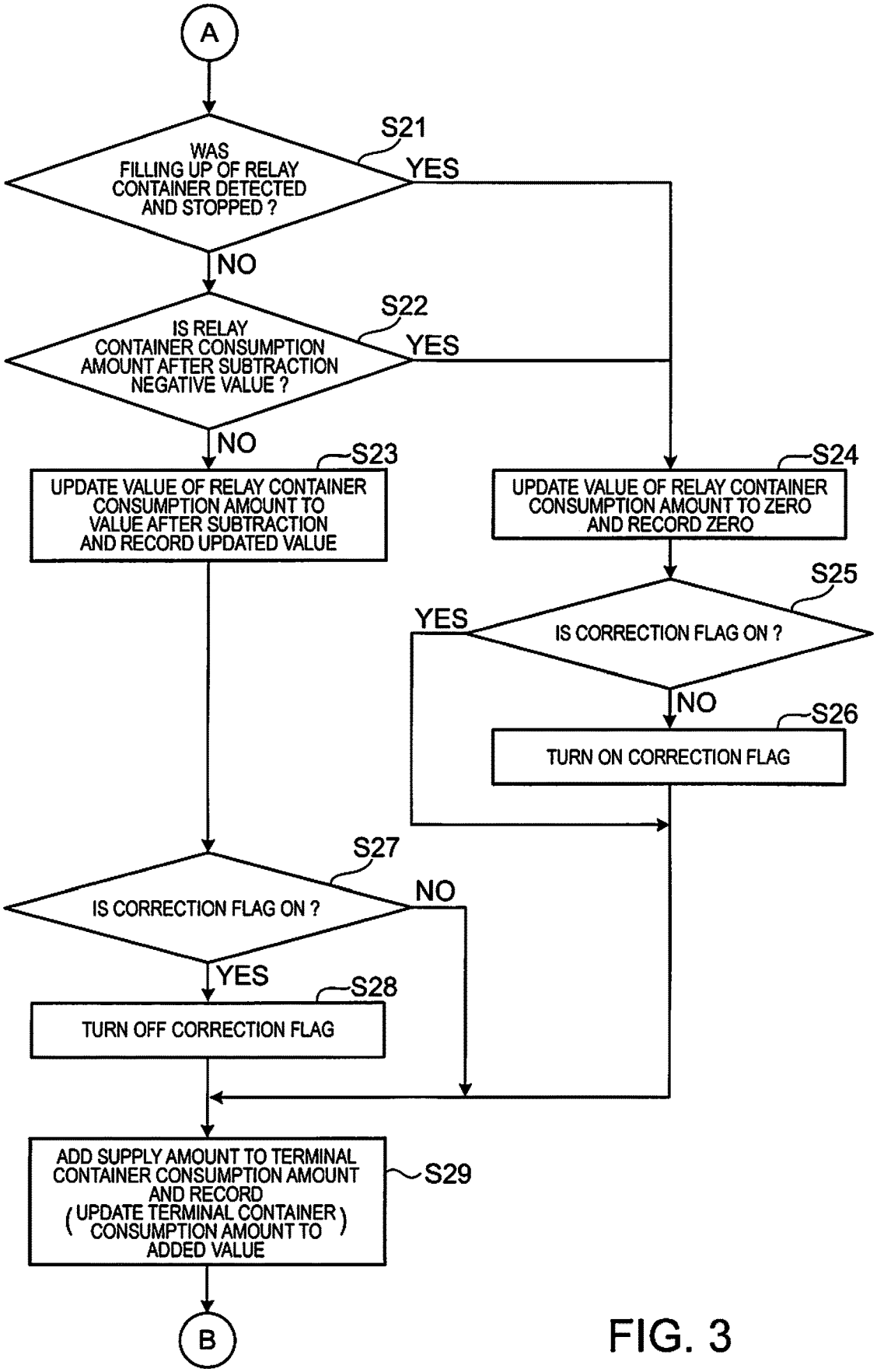
FIG. 3 is a flowchart showing processing for managing the ink residual amount in the printer according to the embodiment.
Figure 4:
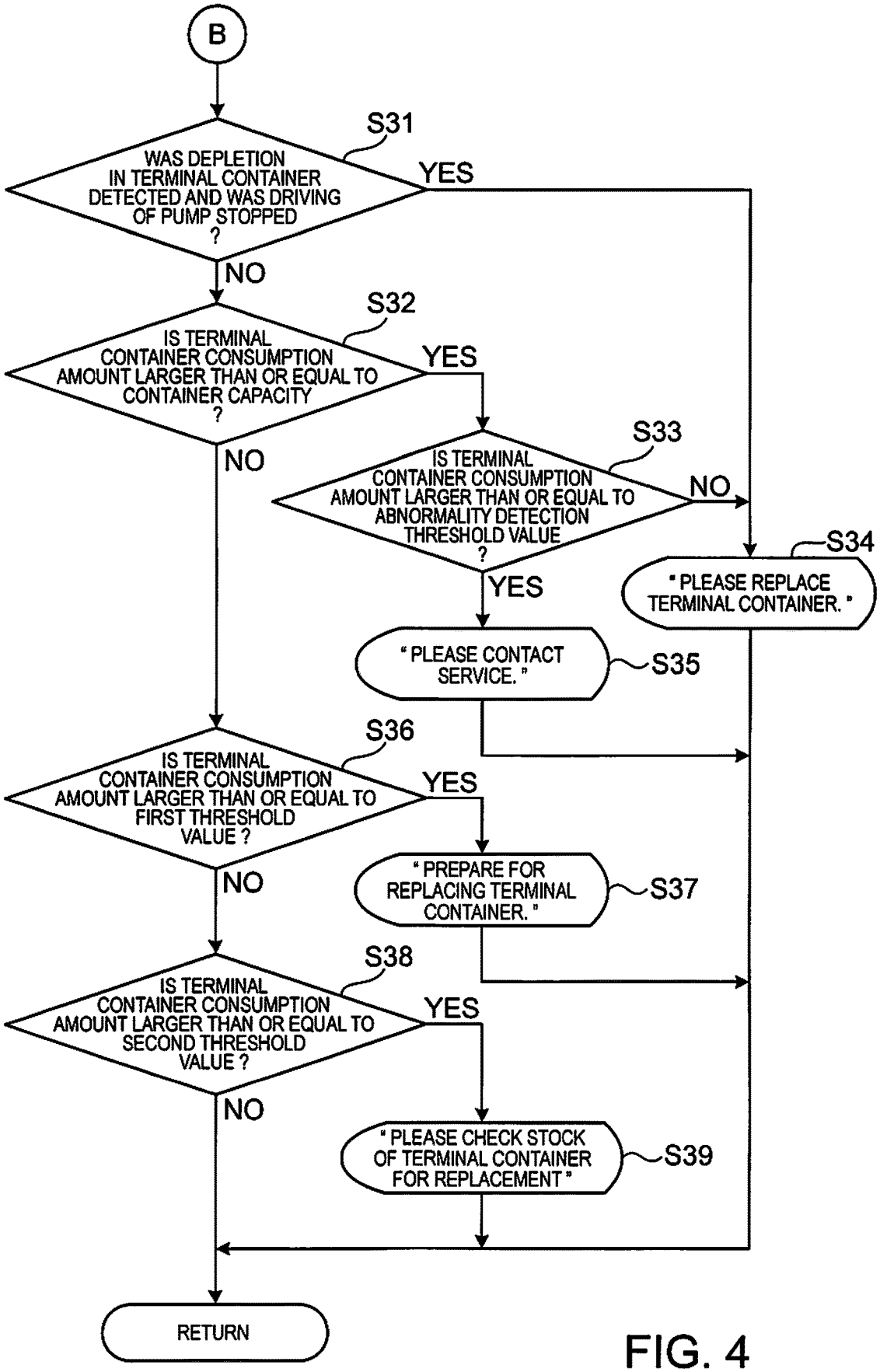
FIG. 4 is a flowchart showing processing for managing the ink residual amount in the printer according to the embodiment.

Next, flow of processing for managing the residual amount of the ink IK in the printer 100 according to this embodiment will be described with reference to FIGS. 2, 3 and 4. FIGS. 2, 3 and 4 are flowcharts showing processing for managing the ink residual amount in the printer according to this embodiment.

Note that in the following description, in the printer 100 shown in FIG. 1, constituent elements of the control unit 10 are collectively referred to as the control unit 10 simply. Similarly, constituent elements of the UI unit 50 are collectively referred to as the UI unit 50 simply, and constituent elements of the relay container 30 are collectively referred to as the relay container 30 simply.

In this embodiment, the control unit 10 executes the processing of the steps of the flowcharts shown in FIGS. 2, 3 and 4 when the ink IK in the relay container 30 is not supplied to the recording head 22, or in other words, when a printing job and cleaning of the recording head 22 are not executed (when the ink IK is not discharged) after the printer 100 executed a printing job or cleaning of the recording head 22, and consumed the ink IK (when the discharge amount exceeded zero).

In addition, if the printer 100 has the relay containers 30 and the terminal containers 60 that store the ink IK of a plurality of different colors, the control unit 10 sequentially selects the target relay container 30 and the target terminal container 60 from the relay containers 30 and the terminal containers 60 of the colors, and executes the processing of the steps on the relay container 30 and the terminal container 60 of the selected color. Note that the processing of the steps may be executed on the relay containers 30 and the terminal containers 60 that store the ink IK of the different colors in parallel.

In the main body storage 40, the latest relay container consumption amount (the estimated consumption amount of the first container) acquired by performing integration from the initial state (the initial value is zero. A state where the relay container 30 is filled with the ink IK to a full state when the printer 100 is used for the first time, and the relay container consumption amount is set to zero) is recorded as the estimated consumption amount 42 of the relay container. In the terminal container storage 62 of the terminal container 60, the latest terminal container consumption amount (the estimated consumption amount of the second container) acquired by integrating the amounts of ink consumed from the terminal container 60 from the initial state (the initial value is zero) of the terminal container 60 is recorded as the estimated consumption amount 64 of the terminal container.

First, in step S01 shown in FIG. 2, the control unit 10 calculates the discharge amount of the ink IK (the ink consumption amount) discharged from the recording head 22, adds the calculated discharge amount of the ink IK to the estimated consumption amount 42 of the relay container read out from the main body storage 40, updates the estimated consumption amount 42 of the relay container with the result of the addition, and records the updated amount in the main body storage 40. Accordingly, the relay container consumption amount is updated to a value after the ink IK is discharged.

Next, in step S02, the control unit 10 determines whether or not the updated relay container consumption amount (the estimated consumption amount 42 of the relay container) is larger than or equal to a predetermined amount that is set based on the predetermined capacity of the relay container 30. If it is determined that the relay container consumption amount is larger than or equal to the predetermined amount (step S02: YES), the control unit 10 determines that it is necessary to supply the ink IK from the terminal container 60 to the relay container 30, and advances the procedure to step S03. If it is determined that the relay container consumption amount is smaller than the predetermined amount (step S02: NO), the control unit 10 advances the procedure to step S31 in FIG. 4.

In step S03, the control unit 10 determines whether or not the terminal container 60 is mounted. Whether or not the terminal container 60 is mounted is determined by detecting whether or not the terminal container storage 62 is electrically connected to the printer 100, for example. If it is determined that the terminal container 60 is mounted (step S03: YES), the control unit 10 advances the procedure to step S07. On the other hand, if it is determined that the terminal container 60 is not mounted (step S03: NO), the control unit 10 advances the procedure to step S04.

In step S04, the control unit 10 determines whether or not the relay container consumption amount is larger than or equal to the predetermined capacity of the relay container 30. If the relay container consumption amount is larger than or equal to the predetermined capacity of the relay container 30, there is a possibility that the relay container 30 has run out of the ink IK. Therefore, if the relay container consumption amount is larger than or equal to the predetermined capacity of the relay container 30 (step S04: YES), the control unit 10 stops the printing operation (consuming operation) of the printer 100 (step S05).

In the printer 100, a configuration is adopted in which, if the relay container 30 runs out of the ink IK, the channel pressure sensor 37 detects the state. However, if the relay container consumption amount becomes larger than or equal to the predetermined capacity of the relay container 30, there is also a possibility that depletion of the ink IK is not detected due to the channel pressure sensor 37 not properly operating. Therefore, in order to prevent the relay container 30 from running out of the ink IK and entering the idling state in a state where the terminal container 60 is not mounted (step S03: NO), the printing operation (consuming operation) of the printer 100 is stopped in step S05, and a printing operation after that is prohibited.

Subsequently, the control unit 10 causes the UI unit 50 to output a message for prompting the user to mount the terminal container 60, such as "the ink residual amount of the relay container is running short. Please mount the terminal container." (step S06). On the other hand, if the relay container consumption amount is smaller than the predetermined capacity of the relay container 30 (step S04: NO), the control unit 10 advances the procedure to step S31 in FIG. 4.

Next, if the procedure advances from step S03 to step S07, in step S07, the control unit 10 divides the relay container consumption amount (the estimated consumption amount 42 of the relay container) by the maximum value of the tolerance of the supply amount per unit for one driving of the depressurizing pump 35 to calculate the number of times of driving (the predetermined number of times) of the depressurizing pump 35 when supplying the ink IK to the relay container 30. The control unit 10 then starts driving of the depressurizing pump 35 (step S08). The control unit 10 starts driving of the depressurizing pump 35 in step S08, and after driving the depressurizing pump 35 the predetermined number of times calculated in step S07, stops driving of the depressurizing pump 35.

However, if the correction flag 44 is turned on through step S26, which will be described later, the above-described predetermined number of times is reduced as appropriate. A reducing method is as described above.

Next, in step S09, it is determined whether or not the depressurizing pump 35 was driven until the predetermined number of times calculated in step S07 is reached, and was stopped. If the depressurizing pump 35 was driven until the predetermined number of times was reached, and was stopped (step S09: YES), the control unit 10 advances the procedure to step S10. In step S10, the control unit 10 calculates the supply amount of the ink IK acquired by multiplying the minimum value of the tolerance of the supply amount per unit by the predetermined number of times, and subtracts the calculated value from the relay container consumption amount (the estimated consumption amount 42 of the relay container).

On the other hand, if driving of the depressurizing pump 35 was stopped before the predetermined number of times is reached (step S09: NO), the control unit 10 advances the procedure to step S11. Factors for stopping driving of the depressurizing pump 35 before the predetermined number of times is reached include the relay container 30 having been filled up with the ink IK, the terminal container 60 having run out of the ink IK, an error having occurred during the operation due to electricity failure, and the like.

In step S11, the control unit 10 calculates the supply amount of the ink IK acquired by multiplying the minimum value of the tolerance of the supply amount per unit by the number of times that the depressurizing pump 35 operated until driving was stopped, and subtracts the calculated value from the relay container consumption amount (the estimated consumption amount 42 of the relay container).

Next, in step S21 shown in FIG. 3, the control unit 10 determines whether or not the channel pressure sensor 37 detected that the relay container 30 was filled up with the ink IK and driving of the depressurizing pump 35 was stopped. If the channel pressure sensor 37 did not detect that the relay container 30 was filled up with the ink IK and driving of the depressurizing pump 35 was not stopped (step S21: NO), the control unit 10 advances the procedure to step S22.

In the subsequent step S22, the control unit 10 determines whether or not the relay container consumption amount that has been updated to the value acquired by subtracting the supply amount in step S10 or S11 is a negative value. If the relay container consumption amount that has been updated to the value acquired by subtracting the supply amount is not a negative value (step S22: NO), it can be determined that residual amount management of the ink IK is properly performed, and thus the control unit 10 advances the procedure to step S23.

However, even if the relay container consumption amount that has been updated to the value acquired by subtracting the supply amount is not a negative value (step S22: NO), if driving of the depressurizing pump 35 was stopped before the predetermined number of times is reached in step S09 shown in FIG. 2 (step S09: NO), a possibility remains that driving of the depressurizing pump 35 was stopped due to the terminal container 60 having run out of the ink IK, or that an error occurred during the operation due to electricity failure and the like. Determination regarding a case where driving of the depressurizing pump 35 was stopped due to the terminal container 60 having run out of the ink IK is performed in step S31 shown in FIG. 4.

In the subsequent step S23, the control unit 10 updates the relay container consumption amount to the value acquired by subtracting the calculated supply amount in step S10, and records, in the main body storage 40, the updated relay container consumption amount as the estimated consumption amount 42 of the relay container. Accordingly, the relay container consumption amount is updated to a value after the ink IK was supplied.

In the subsequent step S27, if the depressurizing pump 35 was driven until the predetermined number of times was reached, and stopped (step S09: YES), and the procedure advanced to step S27, the control unit 10 determines whether or not the correction flag 44 is set in the main body storage 40 (whether or not the correction flag 44 is on). If the correction flag 44 is set, it is indicated that, when the ink IK was supplied to the relay container 30 last time (or before that), the relay container 30 became full before the depressurizing pump 35 completes the operation the predetermined number of times, and the ink supply operation from the terminal container 60 to the relay container 30 was stopped, and thus correction for reducing the supply amount of the ink IK was performed.

If the correction flag 44 is set (step S27: YES), it is conceivable that the depressurizing pump 35 operated the predetermined number of times when the ink IK was supplied to the relay container 30 this time, and that a state of excessive supply of the ink IK was eliminated, and thus the control unit 10 advances the procedure to step S28, and releases the setting of the correction flag 44 (turns off the correction flag 44). The control unit 10 then advances the procedure to step S29. If the correction flag 44 is not set (step S27: NO), the control unit 10 advances the procedure to step S29 in this state.

Returning to step S21, if the channel pressure sensor 37 detected that the relay container 30 was filled up with the ink IK, and driving of the depressurizing pump 35 was stopped (step S21: YES), the control unit 10 advances the procedure to step S24. In this case, it is conceived that, in step S09 shown in FIG. 2, the relay container 30 was filled up with the ink IK before the operation of the depressurizing pump 35 reaches the predetermined number of times, and driving of the depressurizing pump 35 was stopped (step S09: NO).

In addition, if it is determined in step S22 that the relay container consumption amount that has been updated to the value acquired by subtracting the supply amount is a negative value (step S22: YES), the control unit 10 advances the procedure to step S24.

If the procedure advances from step S21 (step S21: YES) to step S24, it is conceivable that the relay container 30 is filled up with the ink IK. Therefore, in step S24, the control unit 10 updates the relay container consumption amount to the initial value (zero), and records the updated relay container consumption amount in the main body storage 40. Accordingly, the calculated relay container consumption amount is reset to the state where the free capacity of the relay container 30 is zero, that is, the state where the relay container 30 is full of the ink IK, and thus it is possible to eliminate the difference between the actual residual amount of the ink IK and the calculated residual amount. In addition, also if the procedure advances from step S22 (step S22: YES) to step S24, the relay container consumption amount is updated to the initial value.

In the subsequent step S29, the control unit 10 adds the value of the amount of the ink IK that is supplied from the terminal container 60 to the relay container 30 to the terminal container consumption amount of the terminal container 60 (the estimated consumption amount 64 of the terminal container), and records the added value in the terminal container storage 62.

In step S29, if it is determined in step S09 shown in FIG. 2 that the depressurizing pump 35 was driven until the predetermined number of times was reached, and was stopped (step S09: YES), the supply amount of the ink IK for the predetermined number of times calculated in step S10 is added to the terminal container consumption amount. On the other hand, if it is determined in step S09 shown in FIG. 2 that driving of the depressurizing pump 35 was stopped before the predetermined number of times is reached (step S09: NO), the supply amount of the ink IK for the number of times that the depressurizing pump 35 actually operated, the supply amount having been calculated in step S11, is added to the terminal container consumption amount.

Accordingly, the terminal container consumption amount is updated to the value after the ink IK was supplied. After updating the terminal container consumption amount, the control unit 10 advances the procedure to step S31 shown in FIG. 4.

In step S31, if driving of the depressurizing pump 35 was stopped before the predetermined number of times is reached in step S09 (step S09: NO), the control unit 10 determines whether or not driving of the depressurizing pump 35 has been stopped as a result of the channel pressure sensor 37 detecting that the terminal container 60 has run out of the ink IK.

If the channel pressure sensor 37 detects that the terminal container 60 has run out of the ink IK, and driving of the depressurizing pump 35 has been stopped (step S31: YES), it is necessary to prompt the user to replace the terminal container 60. Therefore, the control unit 10 advances the procedure to step S34, and causes the UI unit 50 to output a message such as "please replace the terminal container". Note that, as described above, even if the terminal container 60 has run out of the ink IK, the printing operation for a new printing job can be continued while the ink IK remains in the relay container 30.

If the channel pressure sensor 37 does not detect that the terminal container 60 has run out of the ink IK, and driving of the depressurizing pump 35 has not been stopped (step S31: NO), the control unit 10 advances the procedure to step S32. In the subsequent step S32, the control unit 10 determines whether or not the terminal container consumption amount (the estimated consumption amount 64 of the terminal container) recorded in the terminal container storage 62 is larger than or equal to the predetermined capacity of the terminal container 60.

If the terminal container consumption amount is larger than or equal to the predetermined capacity of the terminal container 60 (step S32: YES), it is conceivable that the terminal container 60 has run out of the ink IK, and further that abnormality has occurred such as the channel pressure sensor 37 not operating properly. Therefore, the control unit 10 determines whether or not the terminal container consumption amount in step S33 is larger than or equal to the abnormality detection threshold value in order to check whether or not there is abnormality such as the channel pressure sensor 37 not properly operating. As described above, when the relay container consumption amount at which the terminal container 60 becomes empty if the amount of ink supplied from the terminal container 60 to the relay container 30 is the minimum value of the tolerance is assumed to be 100%, the abnormality detection threshold value is set to be about 120%.

If the terminal container consumption amount is larger than or equal to the abnormality detection threshold value (step S33: YES), it is conceivable that abnormality has occurred such as the channel pressure sensor 37 not operating properly, or the ink IK leaking from the relay container 30. However, the user cannot handle such a case, and thus it is necessary to prompt the user to contact the service. Therefore, the control unit 10 advances the procedure to step S35, and causes the UI unit 50 to output a message such as "there is a possibility that abnormality has occurred. Please contact the service."

If the terminal container consumption amount is smaller than the abnormality detection threshold value (step S33: NO), one cannot go further to say that abnormality has occurred, but it is conceivable that the terminal container 60 has run out of the ink IK, and thus the control unit 10 advances the procedure to step S34.

On the other hand, if it is determined in step S32 that the terminal container consumption amount is smaller than the predetermined capacity of the terminal container 60 (step S32: NO), it is conceivable that the ink IK still remains in the terminal container 60. In view of this, the control unit 10 advances the procedure to step S36 in order to request the user to prepare for replacing the terminal container 60 when the terminal container consumption amount reaches a predetermined threshold value (when the residual amount of the ink IK in the terminal container 60 decreases to some degree).

In step S36, the control unit 10 determines whether or not the terminal container consumption amount (the estimated consumption amount 64 of the terminal container) recorded in the terminal container storage 62 is larger than or equal to the first threshold value. As described above, the first threshold value is set to about 80%.

If the terminal container consumption amount is larger than or equal to the first threshold value (step S36: YES), it is highly possible that the residual amount of the ink IK in the terminal container 60 has become low, or that the terminal container 60 has become empty in the printer 100 in which the amount of ink supplied from the terminal container 60 to the relay container 30 is a standard tolerance, and thus it is preferable to prompt the user to prepare for replacing the terminal container 60 such that the terminal container 60 can be replaced as soon as depletion of the ink occurs. Therefore, the control unit 10 advances the procedure to step S37, and causes the UI unit 50 to output a message such as "prepare for replacing the terminal container."

If the terminal container consumption amount is smaller than the first threshold value (step S36: NO), the control unit 10 advances the procedure to step S38. In step S38, the control unit 10 determines whether or not the terminal container consumption amount (the estimated consumption amount 64 of the terminal container) recorded in the terminal container storage 62 is larger than or equal to the second threshold value. As described above, the second threshold value is set to about 66%.

If the terminal container consumption amount is larger than or equal to the second threshold value (step S38: YES), although the residual amount of the ink IK in the terminal container 60 exists, if the user does not have the terminal container 60 in stock, it is preferable to arrange the terminal container 60 early. Therefore, the control unit 10 advances the procedure to step S39, and causes the UI unit 50 to output a message such as "please check the stock of a terminal container for replacement". If the terminal container consumption amount is smaller than the second threshold value (step S38: NO), the control unit 10 ends the processing.

In the above embodiment, merely one aspect of the invention is illustrated, and any modifications and applications can be made without departing from the scope of the invention. The following modified examples are possible.

Modified Example 1

In the above embodiment, the supply amount per one driving of the depressurizing pump 35 is used as the supply amount per unit of ink supplied from the terminal container 60 to the relay container 30 by the supply means, but the invention is not limited to such an aspect. In the invention, for example, a supply amount per unit time for which the electromagnetic valve 66 is opened may be used as the supply amount per unit of the supply means.

The supply means according to Modified Example 1 is the electromagnetic valve 66 as a valve, and the operation amount of the supply means is a time for which the electromagnetic valve 66 is opened (open time) by the driving control unit 12. An operation of supplying the ink IK from the terminal container 60 to the relay container 30 in Modified Example 1 will be described. In a state where the electromagnetic valve 24 and the electromagnetic valve 66 are closed, the control unit 10 opens the pressure chamber 33 to the atmospheric air, and achieves static pressure. From this state, the control unit 10 drives the depressurizing pump 35 so as to depressurize the pressure chamber 33 to a predetermined value (for example, −20 kPa). If the electromagnetic valve 66 is opened after this, the ink IK of an amount corresponding to a time for which the electromagnetic valve 66 is opened is supplied so as to be sucked up from the terminal container 60 to the container bag 32 via the ink channel 38. In Modified Example 1, a predetermined time (predetermined operation amount) for which the electromagnetic valve 66 is opened is defined, and the electromagnetic valve 66 is opened and when the predetermined time elapsed, the electromagnetic valve 66 is closed, and thereby the supply amount of the ink IK supplied to the relay container 30 can be adjusted.

The supply amount per unit according to Modified Example 1, that is, the size of the tolerance of the liquid feeding amount of the ink IK per unit time (for example, one second) for which the electromagnetic valve 66 is opened depends on variation in the viscosity of the ink IK, the size of the ink channel 38, and the like. If the viscosity of the ink IK is focused on, the lower the viscosity of the ink IK is, the larger the supply amount per unit becomes, and the higher the viscosity of the ink IK is, the smaller the supply amount per unit becomes. The viscosity of the ink IK changes according to change in the temperature of the ink IK and a time that elapsed from the production of the ink IK. Generally, the viscosity of the ink IK tends to be inversely proportional to the temperature (as the temperature rises, the viscosity drops), and the larger the range of temperature change of the ink IK is, the larger the variation in viscosity becomes. In addition, the longer the time that elapsed from the production of the ink IK, the higher the variation in viscosity becomes.

In Modified Example 1, the control unit 10 uses the maximum value of the tolerance of the supply amount per unit that is the supply amount of the ink IK per unit time for which the electromagnetic valve 66 is opened to calculate a predetermined time for which the electromagnetic valve 66 is opened when supplying the ink IK from the terminal container 60 to the relay container 30. Accordingly, even if the liquid feeding amount per unit time for which the electromagnetic valve 66 is opened varies, the amount of the ink IK that is actually supplied to the relay container 30 never exceeds the supply amount calculated using the maximum value of tolerance of the supply amount per unit, and thus it is possible to prevent the relay container 30 being excessively filled with the ink IK.

Note that if the channel pressure sensor 37 detects that the relay container 30 was filled up with the ink IK when supplying the ink IK from the terminal container 60 to the relay container 30, the control unit 10 closes the electromagnetic valve 66 so as to stop liquid feeding of the ink IK even before the predetermined time elapses.

In addition, the control unit 10 calculates the supply amount of the ink IK that is supplied from the terminal container 60 to the relay container 30, using the minimum value of the tolerance of the supply amount per unit. Accordingly, even if the liquid feeding amount per unit time for which the electromagnetic valve 66 is opened varies, the amount of the ink IK that is actually supplied to the relay container 30 is never below the supply amount calculated using the minimum value of the tolerance of the supply amount per unit, and thus depletion of the ink IK in the relay container 30 can be avoided.

In the flow of processing for managing the residual amount of the ink IK according to Modified Example 1, processing different from the above embodiment will be described with reference to FIG. 2. In step S07 shown in FIG. 2, the control unit 10 uses the maximum value of the tolerance of the supply amount (supply amount per unit) per unit time for which the electromagnetic valve 66 is opened to calculate the predetermined time for which the electromagnetic valve 66 is opened, instead of calculating the number of times of driving of the pump. In step S08, the control unit 10 opens the electromagnetic valve 66 to start liquid feeding, and when the predetermined time elapses, or if the channel pressure sensor 37 detects the full state of the relay container 30, closes the electromagnetic valve 66 to stop liquid feeding.

In step S09, it is determined whether or not the electromagnetic valve 66 was closed after the predetermined time has elapsed in a state where the electromagnetic valve 66 is opened. If the electromagnetic valve 66 was closed after the predetermined time elapsed (step S09: YES), the control unit 10 advances the procedure to step S10. In step S10, the control unit 10 calculates the supply amount of the ink IK acquired by multiplying the minimum value of the tolerance of the supply amount per unit by the predetermined time for which the electromagnetic valve 66 is opened, instead of the number of times of driving of pump, and subtracts the calculated value from the relay container consumption amount (the estimated consumption amount 42 of the relay container).

On the other hand, if the electromagnetic valve 66 was closed before the predetermined time elapses (step S09: NO), the control unit 10 advances the procedure to step S11. In step S11, the control unit 10 calculates the supply amount of the ink IK acquired by multiplying the minimum value of the tolerance of the supply amount per unit by a time until the electromagnetic valve 66 is closed, and subtracts the calculated value from the relay container consumption amount (the estimated consumption amount 42 of the relay container).

As described above, also in Modified Example 1, an effect similar to that of the above embodiment is acquired. Accordingly, even if the supply amount of the ink IK per unit time for which the electromagnetic valve 66 is opened varies, it is possible to suppress depletion of the ink IK in the relay container 30, and to suppress reduction in the lifetime of the relay container 30 due to excessive filling of the ink IK.

Modified Example 2

In the above embodiment, a case where the recording apparatus is the printer 100 has been described as an example, but the invention is not limited to such an aspect. The recording apparatus may be a multi-function peripheral (printer system) provided with the printer 100 and a scanner.

Modified Example 3

In the above embodiment, an example in which the invention is applied to a printer and ink has been described, but the invention is not limited to such an aspect. The invention may be applied to a recording apparatus for ejecting and discharging a recording material (liquid) other than ink, for example.

Modified Example 4

A configuration may be adopted in which, while the power supply of the printer 100 is on, and a power saving mode is not set, the control unit 10 always records the estimated consumption amount of the relay container in a RAM or the like, and as appropriate, the estimated consumption amount in the main body storage 40 is updated to the estimated consumption amount of the relay container recorded in the RAM. A configuration is adopted in which, in this case, before transitioning to the power saving mode, when the power supply is off, the latest estimated consumption amount of the relay container is necessarily recorded in the main body storage 40.

What is claimed is:

1. A recording apparatus comprising:

a recording head configured to discharge a recording material;

a first container from which the recording material is supplied to the recording head, and to which the recording material is supplied from a second container;

a supply unit configured to supply the recording material from the second container to the first container, the supply unit being a valve or a pump having a tolerance range of a supply amount which is from a minimum value to a maximum value;

a control unit configured to control an operation of the supply unit, the control unit being further configured to calculate an estimated consumption amount of the first container based on an amount of the recording material supplied from the first container to the recording head and consumed and an amount of the recording material supplied from the second container to the first container by the supply unit, and when calculating the estimated consumption amount of the first container based on the amount of the recording material supplied from the second container to the first container, calculate the amount of the recording material supplied from the second container to the first container using the minimum value of the tolerance range of the supply amount of the valve or the pump; and a storage, wherein the control unit records the estimated consumption amount of the first container in the storage, and when the estimated consumption amount of the first container is calculated based on the amount of the recording material supplied from the second container to the first container, if the estimated consumption amount of the first container is a negative value, the control unit assumes that the estimated consumption amount of the first container is zero, and updates the estimated consumption amount of the first container in the storage.

2. The recording apparatus according to claim 1, wherein the control unit causes the supply unit to supply the recording material from the second container to the first container when the estimated consumption amount of the first container becomes larger than or equal to a predetermined amount set based on a predetermined capacity of the first container.

3. The recording apparatus according to claim 1, wherein the control unit performs the calculation of the amount of the recording material supplied from the second container to the first container, using the minimum value of the tolerance of a supply amount of the valve or the pump, by integrating the minimum value of tolerance of a supply amount per unit of the recording material supplied from the second container to the first container for an operation amount of the operation of the supply unit.

4. The recording apparatus according to claim 3, wherein if the recording material is supplied at the maximum value of the tolerance of the supply amount per unit of the valve or the pump, the control unit causes the supply unit to execute the operation so as to supply the recording material in an amount such that the estimated consumption amount of the first container is an initial value.

5. The recording apparatus according to claim 4, wherein the control unit sets, as a predetermined operation amount, an integer value that is smaller than or equal to a value acquired by dividing the estimated consumption amount of the first container by the maximum value of the tolerance of the supply amount per unit, and causes the supply unit to execute the operation by the predetermined operation amount.

6. The recording apparatus according to claim 5 further comprising:

a sensor for detecting that the first container is filled with the recording material to the predetermined capacity of the first container, wherein if the sensor detects that the first container has been filled with the recording material to the predetermined capacity of the first container before execution of the operation of the supply unit by the predetermined operation amount is complete, the control unit stops the operation of the supply unit, and performs the calculation of an amount of the recording material supplied from the second container to the first container by integrating the minimum value of the tolerance of the supply amount per unit for an amount of the operation executed until the detection of the sensor.

7. The recording apparatus according to claim 6, wherein the control unit corrects a value of the predetermined operation amount for the next supply of the recording material from the second container to the first container by the supply unit if the sensor detects that the recording material has been charged to the predetermined capacity of the first container before execution of the operation of the supply unit by the predetermined operation amount is complete.

8. The recording apparatus according to claim 3, wherein the supply amount per unit is a supply amount per unit time for which the valve is opened, and the time for which the valve is open serves as the operation amount.

9. The recording apparatus according to claim 3, wherein the supply amount per unit is a supply amount per one driving of the pump, and the number of times that the pump is driven serves as the operation amount.

10. The recording apparatus according to claim 1, wherein when calculating the estimated consumption amount of the first container based on the amount of the recording material supplied from the first container to the recording head and consumed, the control unit uses the maximum value of tolerance of a discharge amount of the recording material discharged from the recording head.

11. A recording apparatus comprising:

a recording head configured to discharge a recording material;

a first container from which the recording material is supplied to the recording head, and to which the recording material is supplied from a second container;

a supply unit configured to supply the recording material from the second container to the first container, the supply unit being a valve or a pump having a tolerance range of a supply amount which is from a minimum value to a maximum value; and a control unit configured to control an operation of the supply unit, the control unit being further configured to calculate an estimated consumption amount of the first container based on an amount of the recording material supplied from the first container to the recording head and consumed and an amount of the recording material supplied from the second container to the first container by the supply unit, and when calculating the estimated consumption amount of the first container based on the amount of the recording material supplied from the second container to the first container, calculate the amount of the recording material supplied from the second container to the first container using the minimum value of the tolerance range of the supply amount of the valve or the pump, wherein the second container has a second container storage, the control unit records, in the second container storage, the estimated amount of the recording material supplied from the second container to the first container and consumed from the second container, and the control unit updates an estimated consumption amount of the second container based on the minimum value of the tolerance of the supply amount per unit of the valve or the pump, and records the updated estimated consumption amount in the second container storage.

12. The recording apparatus according to claim 11 further comprising:

a user interface unit, wherein the control unit causes the user interface unit to output display for prompting a user to replace the second container, based on the estimated consumption amount of the second container.

13. The recording apparatus according to claim 12, wherein the control unit causes the user interface unit to output display for prompting the user to prepare for replacing the second container, based on the estimated consumption amount of the second container.

14. The recording apparatus according to claim 12, wherein if the estimated consumption amount of the first container is larger than or equal to the predetermined capacity of the first container, the control unit checks whether or not the second container is mounted to the recording apparatus, and if the second container is not mounted to the recording apparatus, causes the user interface unit to output display for prompting the user to mount the second container.

15. A recording apparatus comprising:

a recording head configured to discharge a recording material;

a first container from which the recording material is supplied to the recording head, and to which the recording material is supplied from a second container;

a supply unit configured to supply the recording material from the second container to the first container, the supply unit being a valve or a pump having a tolerance range of a supply amount which is from a minimum value to a maximum value; and a control unit configured to control an operation of the supply unit, the control unit being further configured to calculate an estimated consumption amount of the first container based on an amount of the recording material supplied from the first container to the recording head and consumed and an amount of the recording material supplied from the second container to the first container by the supply unit, and when calculating the estimated consumption amount of the first container based on the amount of the recording material supplied from the second container to the first container, calculate the amount of the recording material supplied from the second container to the first container using the minimum value of the tolerance range of the supply amount of the valve or the pump, wherein the second container has a second container storage, the control unit records, in the second container storage, the estimated amount of the recording material supplied from the second container to the first container and consumed from the second container, and when the recording material is supplied from the second container to the first container by the supply unit, the control unit updates the estimated consumption amount of the second container.

* * * * *